US008043778B2

(12) United States Patent
Nagatomo et al.

(10) Patent No.: US 8,043,778 B2
(45) Date of Patent: Oct. 25, 2011

(54) TONER, METHOD FOR PREPARING THE TONER, AND IMAGE FORMING APPARATUS USING THE TONER

(75) Inventors: Tsuneyasu Nagatomo, Numazu (JP); Naohiro Watanabe, Sunto-gun (JP); Osamu Uchinokura, Mishima (JP); Satoshi Kojima, Numazu (JP)

(73) Assignee: Ricoh Company Limited, Tokyo (JP)

( * ) Notice: Subject to any disclaimer, the term of this patent is extended or adjusted under 35 U.S.C. 154(b) by 868 days.

(21) Appl. No.: 11/852,778

(22) Filed: Sep. 10, 2007

(65) Prior Publication Data

US 2008/0070144 A1 Mar. 20, 2008

(30) Foreign Application Priority Data

Sep. 15, 2006 (JP) ..... 2006-250780

(51) Int. Cl.
*G03G 9/08* (2006.01)

(52) U.S. Cl. ..... 430/108.1; 430/108.24; 430/109.4; 430/101.1; 430/110.2; 430/110.3

(58) Field of Classification Search ..... 430/108.1, 430/108.24, 109.4, 101.1, 110.2, 110.3
See application file for complete search history.

(56) References Cited

U.S. PATENT DOCUMENTS

| | | | |
|---|---|---|---|
| 6,360,068 | B1 | 3/2002 | Kinoshita et al. |
| 6,416,914 | B1 | 7/2002 | Nakamura et al. |
| 6,432,589 | B1 | 8/2002 | Uchinokura et al. |
| 6,432,590 | B1 | 8/2002 | Ueda et al. |
| 6,479,204 | B1 | 11/2002 | Uchinokura et al. |
| 6,503,676 | B2 | 1/2003 | Yamashita et al. |
| 6,641,969 | B2 | 11/2003 | Uchinokura et al. |
| 6,733,939 | B2 | 5/2004 | Nanya et al. |
| 6,737,210 | B2 | 5/2004 | Uchinokura et al. |
| 6,756,175 | B2 | 6/2004 | Emoto et al. |
| 6,787,280 | B2 | 9/2004 | Yamashita et al. |
| 6,818,370 | B2 | 11/2004 | Uchinokura et al. |
| 6,846,604 | B2 | 1/2005 | Emoto et al. |

(Continued)

FOREIGN PATENT DOCUMENTS

JP 62-266550 11/1987

(Continued)

OTHER PUBLICATIONS

U.S. Appl. No. 12/203,278, filed Sep. 3, 2008, Yamada, et al.

(Continued)

*Primary Examiner* — Hoa Le
(74) *Attorney, Agent, or Firm* — Oblon, Spivak, McClelland, Maier & Neustadt, L.L.P.

(57) ABSTRACT

A toner including toner particles including a binder resin, and a modified layered inorganic material in which at least part of interlayer ions is replaced with an organic ion, and a fatty acid metal compound located on a surface of the toner particles; and an external additive located on the fatty acid metal compound, wherein the external additive is a material different from the fatty acid metal compound. An image forming apparatus including an image bearing member; a developing device configured to develop the electrostatic latent image with a developer including the toner; a transfer device; and a fixing device. A method for preparing the toner including dispersing or emulsifying a toner composition including a modified layered inorganic material to prepare toner particles; mixing a fatty acid metal compound with the toner particles; and second mixing the toner particles with an external additive.

22 Claims, 4 Drawing Sheets

U.S. PATENT DOCUMENTS

| | | | | |
|---|---|---|---|---|
| 6,849,369 | B2 | 2/2005 | Yagi et al. | |
| 6,852,462 | B2 | 2/2005 | Emoto et al. | |
| 6,855,468 | B1 | 2/2005 | Yamamoto et al. | |
| 6,916,587 | B2 | 7/2005 | Fushimi et al. | |
| 6,936,390 | B2 | 8/2005 | Nanya et al. | |
| 7,056,635 | B2 | 6/2006 | Tanaka et al. | |
| 7,056,638 | B1 | 6/2006 | Tomita et al. | |
| 7,208,256 | B2 | 4/2007 | Tanaka et al. | |
| 7,217,487 | B2 | 5/2007 | Nanya et al. | |
| 7,241,545 | B2 | 7/2007 | Nanya et al. | |
| 7,258,959 | B2 | 8/2007 | Nakayama et al. | |
| 2004/0131961 | A1 | 7/2004 | Watanabe et al. | |
| 2004/0157146 | A1 | 8/2004 | Tomita et al. | |
| 2004/0265721 | A1 | 12/2004 | Matsuoka et al. | |
| 2005/0003289 | A1 | 1/2005 | Fushimi et al. | |
| 2005/0031980 | A1 | 2/2005 | Inoue et al. | |
| 2005/0042534 | A1 | 2/2005 | Tanaka et al. | |
| 2005/0089786 | A1 | 4/2005 | Sugiura et al. | |
| 2005/0089787 | A1 | 4/2005 | Uchinokura et al. | |
| 2005/0164112 | A1 | 7/2005 | Ohki et al. | |
| 2005/0164114 | A1 | 7/2005 | Yagi et al. | |
| 2005/0208408 | A1 | 9/2005 | Uchinokura et al. | |
| 2005/0208411 | A1 | 9/2005 | Nakayama et al. | |
| 2005/0277044 | A1 | 12/2005 | Watanabe et al. | |
| 2005/0277045 | A1 | 12/2005 | Saito et al. | |
| 2006/0029433 | A1 | 2/2006 | Saito et al. | |
| 2006/0046174 | A1 | 3/2006 | Ohki et al. | |
| 2006/0057488 | A1 | 3/2006 | Inoue et al. | |
| 2006/0063081 | A1 | 3/2006 | Nagatomo et al. | |
| 2006/0063089 | A1 | 3/2006 | Tanaka et al. | |
| 2006/0068312 | A1 | 3/2006 | Yamashita et al. | |
| 2006/0099529 | A1 | 5/2006 | Tanaka et al. | |
| 2006/0160011 | A1 | 7/2006 | Inoue et al. | |
| 2006/0172214 | A1 * | 8/2006 | Saito et al. | 430/108.11 |
| 2006/0204883 | A1 | 9/2006 | Nakayama et al. | |
| 2006/0210903 | A1 | 9/2006 | Ohki et al. | |
| 2006/0240349 | A1 | 10/2006 | Watanabe et al. | |
| 2006/0251979 | A1 | 11/2006 | Watanabe et al. | |
| 2007/0003855 | A1 * | 1/2007 | Veregin et al. | 430/108.3 |
| 2007/0031748 | A1 | 2/2007 | Kotsugai et al. | |
| 2007/0031752 | A1 | 2/2007 | Watanabe et al. | |
| 2007/0037085 | A1 | 2/2007 | Ishii et al. | |
| 2007/0042284 | A1 | 2/2007 | Takada et al. | |
| 2007/0054210 | A1 | 3/2007 | Ohki et al. | |
| 2007/0059626 | A1 | 3/2007 | Inoue et al. | |
| 2007/0134581 | A1 | 6/2007 | Uchinokura et al. | |
| 2007/0141506 | A1 | 6/2007 | Inoue et al. | |
| 2008/0070144 | A1 | 3/2008 | Nagatomo et al. | |

FOREIGN PATENT DOCUMENTS

| | | | |
|---|---|---|---|
| JP | 5-66600 | | 3/1993 |
| JP | 8-211655 | | 8/1996 |
| JP | 10-20552 | | 1/1998 |
| JP | 11-7156 | | 1/1999 |
| JP | 2000-47425 | | 2/2000 |
| JP | 2003-202708 | | 7/2003 |
| JP | 2005-49858 | | 2/2005 |
| JP | 2006-227190 | | 8/2006 |
| JP | 2007-78925 | | 3/2007 |
| WO | WO 01/40878 | A1 | 6/2001 |
| WO | WO 2004/019137 | A1 | 3/2004 |
| WO | WO 2004/019138 | A1 | 3/2004 |

OTHER PUBLICATIONS

U.S. Appl. No. 12/209,583, filed Sep. 12, 2008, Seshita, et al.
U.S. Appl. No. 12/260,493, filed Oct. 29, 2008, Sawada, et al.
U.S. Appl. No. 11/687,372, filed Mar. 16, 2007, Masahide Yamada, et al.
U.S. Appl. No. 11/687,404, filed Mar. 16, 2007, Takuya Seshita, et al.
U.S. Appl. No. 11/687,060, filed Mar. 16, 2007, Shigeru Emoto, et al.
U.S. Appl. No. 11/687,329, filed Mar. 16, 2007, Masayuki Ishii, et al.
U.S. Appl. No. 11/685,969, filed Mar. 14, 2007, Osamu Uchinokura, et al.
U.S. Appl. No. 12/035,862, filed Feb. 22, 2008, Nagatomo, et al.

* cited by examiner

TONER, METHOD FOR PREPARING THE TONER, AND IMAGE FORMING APPARATUS USING THE TONER

BACKGROUND OF THE INVENTION

1. Field of the Invention

The present invention relates to a toner for developing electrostatic images, and more particularly to a toner for use in direct or indirect electrophotographic developing methods. In addition, the present invention also relates to a toner container containing the toner, a developer including the toner, a method for preparing the toner, and a process cartridge and an image forming apparatus using the toner.

2. Discussion of the Background

Electrophotographic image forming methods have been used for various fields. Electrophotographic image forming methods typically include the following processes.

(1) charging the surface of an image bearing member such as photoreceptors (charging process):
(2) irradiating the charged image bearing member with light to form an electrostatic latent image on the image bearing member (light irradiation process);
(3) developing the electrostatic latent image with a developer including a toner to form a toner image on the image bearing member (development process);
(4) transferring the toner image onto a receiving material fed from a sheet feeding device optionally via an intermediate transfer medium (transfer process);
(5) fixing the toner image to the receiving material upon application of heat and pressure thereto (fixing process); and
(6) removing toner particles remaining on the image bearing member and intermediate transfer medium without being transferred so that the image bearing member and intermediate transfer medium are ready for the next image forming processes (cleaning process).

Pulverization methods are well known as toner preparation methods. Pulverization methods typically include the following processes:

(1) melting and kneading a toner composition including a thermoplastic resin serving as a binder resin, a colorant, an optional additive, etc. upon application of heat thereto (kneading process);
(2) cooling the kneaded toner composition (cooling process);
(3) pulverizing the cooled toner composition (pulverization process); and
(4) classifying the pulverized toner composition to prepare toner particles (classification process).

Toners prepared by such pulverization methods typically have a large average particle diameter, and therefore it is difficult for the toners to produce high quality images.

In attempting to produce high quality images, polymerization methods and emulsifying/dispersing methods have been proposed. Specific examples of the polymerization methods include suspension polymerization methods in which toner components such as monomers, polymerization initiators, colorants and charge controlling agents are dispersed in an aqueous medium including a dispersant to form drops of an oil phase, and then the oil drops are polymerized to prepare toner particles in the aqueous medium; and association methods in which particles obtained by an emulsion or suspension polymerization method are agglomerated and fused to prepare agglomerated and fused particles, resulting in formation of toner particles.

Although toners prepared by such polymerization methods have a relatively small average particle diameter, the polymerization toners have a drawback in that the binder resin is limited to resins obtained by a radical polymerization method. Namely, resins such as polyester resins and epoxy resins which are preferably used as binder resins of color toners cannot be used therefore.

In attempting to remedy the drawback, emulsifying/dispersing methods in which a mixture of toner constituents such as binder resins and colorants is dispersed in an aqueous medium and emulsified to prepare toner particles have been proposed, for example, in published unexamined Japanese patent applications Nos. (hereinafter referred to as JP-As) 05-66600 and 08-211655. By using these emulsifying/dispersing methods, toner particles with a small average particle diameter can be prepared and various resins can be used for the binder resin of the toner particles. However, the emulsifying/dispersing methods have a drawback in that particles with too small particle diameters are produced, resulting in increase of emulsification loss (i.e., increase of the manufacturing costs).

In attempting to remedy the drawback, JP-As 10-020552 and 11-007156 have disclosed emulsion association methods in which particles prepared by an emulsion method using a polyester resin are agglomerated and fused to prepare agglomerated and fused particles, resulting in formation of toner particles. By using these methods, formation of particles with too small particle diameters can be prevented, and thereby emulsification loss can be reduced.

However, toners prepared by the polymerization methods and emulsifying/dispersing methods tend to have spherical forms due to the interfacial tension of the drops prepared in the dispersing process. Spherical toners cause a cleaning problem in that toner particles remaining on the surface of an image bearing member even after an image transfer process cannot be well removed with a cleaning blade because such spherical toner particles tend to enter the gap between the tip of a cleaning blade and the surface of the image bearing member.

In attempting to solve the cleaning problem, JP-A 62-266550 discloses a technique in that high speed agitation is performed on a dispersion before completion of the polymerization reaction of the dispersion to apply a mechanical force to the particles, so that the resultant toner particles have irregular forms. However, by using this technique, another problem such that the dispersion becomes unstable and thereby particles are united tends to occur.

In addition, JP-A 02-51164 discloses a technique in that particles are agglomerated using a polyvinyl alcohol having a specific saponification value as a dispersant to prepare agglomerated particles (i.e., toner particles) having particle diameters of from 5 to 25 μm. However, the toner particles have large particle diameters.

Further, JP-A 2005-49858 also discloses a technique in that a toner composition liquid including a toner composition, and a filler are added to an organic solvent to form toner particles having irregular forms. However, toners including a filler therein have a high viscoelasticity, and thereby the minimum fixable temperature of the toners increases. When a filler is added to a toner so as to be present on the surface of the toner particles, the viscoelasticity of the toner hardly increases. However, when a filler is present on the surface of the toner particles, problems in that a wax (serving as a release agent) included in the toner particles can hardly exude from the toner particles and the binder resin in the toner particles is prevented from melting away at a fixing process, resulting in deterioration of the low temperature fixability of the toner and occurrence of a hot offset phenomenon.

Further, PCT patent application publications Nos. 2003-515795 (WO01/040878), 2006-500605 (WO2004/019138), and 2006-503313 (WO2004/019137), and JP-A 2003-202708 have disclosed to use layered inorganic materials, in which interlayer ions (such as metal cations) are modified with an organic cation, as charge controlling agents of toner. However, toners including such a modified layered inorganic material have a drawback in that the charge stability thereof deteriorates particularly when environmental conditions largely changed, and thereby the image density of the images produced by the toners is seriously varied.

Because of these reasons, a need exists for a toner which can produce high quality images with good fine-dot reproducibility and good color reproducibility and which has a good combination of fixability, transferability, cleanability, transparency and environmental stability.

SUMMARY OF THE INVENTION

As an aspect of the present invention, a toner is provided which includes toner particles and external additives present on the surface of the toner particles. The toner particles include at least a binder resin and a modified layered inorganic material in which at least part of interlayer ions is replaced with an organic ion, and a fatty acid metal compound serving as an external additive is located on a surface of the toner particles. Another external additive different from the fatty acid metal compound is located on the fatty acid metal compound.

As another aspect of the present invention, a toner container is provided which contains the toner mentioned above.

As yet another aspect of the present invention, a developer is provided which includes the toner mentioned above and a carrier. The toner itself can be used as a one-component developer.

As a further aspect of the present invention, an image forming apparatus is provided which includes an image bearing member configured to bear an electrostatic latent image thereon, a developing device configured to develop the electrostatic latent image with a developer including the toner mentioned above to form a toner image on the image bearing member, a transfer device configured to transfer the toner image onto a receiving material optionally via an intermediate transfer medium, and a fixing device configured to fix the toner image on the receiving material.

As a still further aspect of the present invention, a process cartridge is provided which includes at least an image bearing member configured to bear an electrostatic latent image thereon, and a developing device configured to develop the electrostatic latent image with a developer including the toner mentioned above to form a toner image on the image bearing member, which detachably attachable to an image forming apparatus as a single unit.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
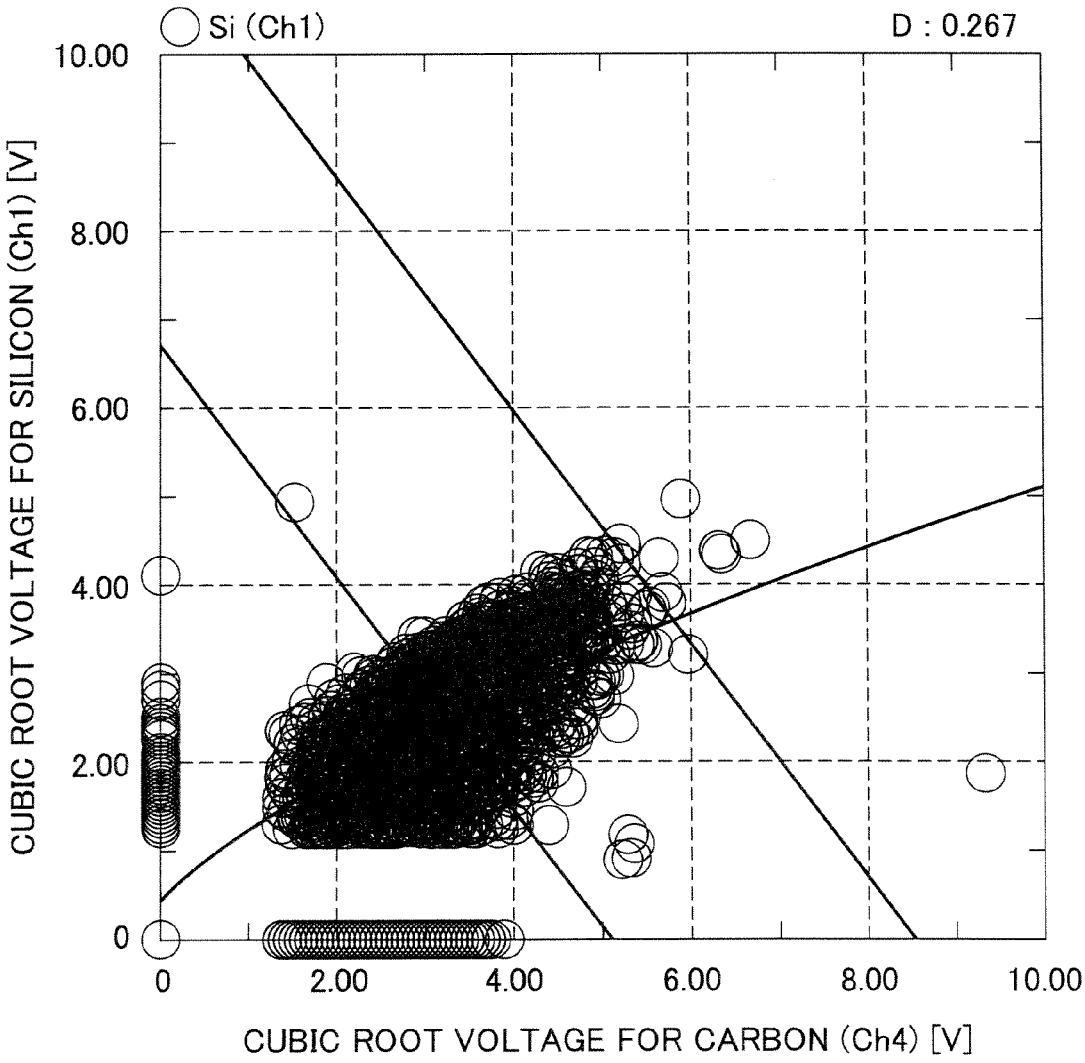
FIG. 1 is a graph illustrating the relationship between cubic root voltages (equivalent particle diameter) for carbon atoms in toner particles of a toner and cubic root voltages (equivalent particle diameter) for silicon atoms in external additive particles of the toner.

At first, modified layered inorganic materials in which at least part of interlayer ions is modified with organic ions and which are used for toner particles of the toner of the present invention will be explained.

Layered inorganic materials are defined as inorganic minerals in which layers having a thickness of few nanometers are overlaid. Modifying the materials with organic ions means that one or more organic ions are incorporated as interlayer ions. This is called intercalation. Intercalation is explained in detail in PCT publications Nos. WO01/040878, WO2004/019138 and WO2004-019137. Specific examples of the layered inorganic materials include smectite family (e.g., montmorillonite and saponite), kaolin family (e.g., kaolinite), magadiite, and kanemite. Because of having a layered structure, the layered inorganic materials have good hydrophilicity. When such an unmodified layered inorganic material is included in a toner composition liquid and the toner composition liquid is dispersed in an aqueous medium to prepare toner particles, the material is migrated into the aqueous medium, and thereby deformation of toner particles cannot be performed (i.e., spherical toner particles are formed and toner particles having forms other than spherical form (i.e., irregular forms) cannot be prepared). When a modified layered inorganic material, which has a greater hydrophobicity (less hydrophilicity) than unmodified layered inorganic materials, is used, the material forms fine toner particles with irregular forms in a granulation process (i.e., the toner particle preparation process). In addition, the material tends to be present in a surface portion of the resultant toner particles, and thereby a good charge controlling function of the modified layered inorganic material can be imparted to the toner. Further, a good low temperature fixability can also be imparted to the toner particles. The added amount of a modified layered inorganic material in the toner composition liquid is preferably from 0.05 to 10% by weight, and more preferably from 0.05 to 5% by weight, based on the total weight of the solid components included in the toner composition liquid.

The modified layered inorganic material for use in the toner of the present invention is preferably a layered inorganic material having a smectite crystal form and modified by an organic cation. In addition, it is preferable to replace a divalent metal ion of the layered inorganic material with a trivalent metal ion to incorporate a metal anion in the layered inorganic material. In this regard, the metal-anion-incorporated layered inorganic material has high hydrophilicity, and therefore it is preferable to replace at least part of the metal anions with an organic anion.

Suitable organic compounds for use in incorporating organic ions in layered inorganic materials include quaternary alkyl ammonium salts, phosphonium salts, imidazolium salts, etc. Among these compounds, quaternary alkyl ammonium salts are preferable. Specific examples of the quaternary alkyl ammonium salts include trimethylstearyl ammonium, dimethylstearylbenzyl ammonium, oleylbis(2-hydroxyethyl) methyl ammonium, etc.

Specific examples of other organic compounds for use in incorporating organic ions include sulfates, sulphonates, carboxylates, and phosphates having a group (or a structure)

such as linear, branched or cyclic alkyl groups (C1-C44), alkenyl groups (C1-C22), alkoxyl groups (C8-C32), hydroxyalkyl groups (C2-C22), ethylene oxide structure, and propylene oxide structure. Among these compounds, carboxylic acids having an ethylene oxide structure are preferably used.

When at least part of interlayer ions of a layered inorganic material is modified with one or more organic ions, the modified layered inorganic material has proper hydrophobicity. By including such a modified layered inorganic material in a toner composition liquid, the toner composition liquid has a non-Newtonian viscosity, and thereby toner particles with irregular forms can be prepared. As mentioned above, the added amount of a modified layered inorganic material in the toner composition liquid is preferably from 0.05 to 10% by weight, and more preferably from 0.05 to 5% by weight, based on the total weight of the solid components included in the toner composition liquid. Modified versions of layered inorganic materials such as montmorillonite, bentonite, hectolite, hectorite, attapulgite, sepiolite, and mixtures of these materials are preferably used. Among these materials, modified montmorillonite and bentonite are preferably used because the modified versions of these materials can easily adjust the viscosity of a toner composition liquid even in a small added amount without deteriorating the properties of the resultant toner.

Specific examples of the marketed products of organic-cation-modified layered inorganic materials include quaternium 18 bentonite such as BENTONE 3, BENTONE 38, BENTONE 38V, (from Elementis Specialties), THIXOGEL VP (from United Catalyst), CLAYTON 34, CLAYTON 40, and CLAYTON XL (from Southern Clay Products); stearalkonium bentonite such as BENTONE 27 (from Elementis Specialties), THIXOGEL LG (from United Catalyst), CLAYTON AF and CLAYTON APA (from Southern Clay Products); quaternium 18/benzalkonium bentonite such as CLAYTON HT and CLAYTON PS (from Southern Clay Products), etc. Among these materials, CLAYTON AF and CLAYTON APA are preferably used.

Specific examples of the marketed products of organic-anion-modified layered inorganic materials include materials which are prepared by modifying DHT-4A (from Kyowa Chemical Industry Co., Ltd.) with a material having the following formula (1) (such as HITENOL 330T from Dai-ichi Kogyo Seiyaku Co., Ltd.).

$$R_1(OR_2)_nOSO_3M \quad (1)$$

wherein $R_1$ represents an alkyl group having 13 carbon atoms; $R_2$ represents an alkylene group having 2 to 6 carbon atoms; n is an integer of from 2 to 10, and M represents a monovalent metal element.

By using a modified layered inorganic material, which has proper hydrophobicity, the resultant toner composition liquid can have a non-Newtonian viscosity, and thereby toner particles with irregular forms can be performed.

In general, when a modified layered inorganic material is used for a toner, the charging properties of the toner largely vary particularly when environmental conditions change, resulting in variation of the image density of images produced by the toner.

In the present invention, the surface of toner particles is covered with a fatty acid metal compound and then an external additive, which is different from the fatty acid metal compound, is adhered to the surface of the toner particles to impart good charge stability to the toner. Thereby, occurrence of the above-mentioned image density problem can be prevented.

The method for preparing the toner of the present invention is as follows. Specifically, the method includes a fatty acid metal compound addition process in which a fatty acid metal compound is mixed with toner particles so that the fatty acid metal compound covers at least a surface of the toner particles; and an external additive addition process in which an external additive, which is different from the fatty acid metal compound, is added to the toner particles covered with the fatty acid metal compound. In the fatty acid metal compound addition process, toner particles and a fatty acid metal compound having an average particle diameter of from 0.1 to 3.0 μm are mixed while applying a considerable shearing force using a dry mixer such as HENSCHEL MIXER. In this case, the particulate fatty acid metal compound is spread on the surface of the toner particles, resulting in formation of a layer of the fatty acid metal compound. When the fatty acid achieves such a state, the ratio of free particles of the fatty acid metal compound decreases, and in addition the variation in adhesion of the fatty acid metal compound to the toner particles decreases. By using this method, a toner having a structure such that a layer of a fatty acid metal compound is formed on at least a surface of toner particles and an external additive different from the fatty acid metal compound is adhered to the layer of the fatty acid metal compound can be efficiently provided.

The volume average particle diameter of the fatty acid metal compound to be mixed with toner particles is preferably from 0.1 to 3.0 μm, and more preferably not greater than 1.0 μm. When the volume average particle diameter is too large, it is difficult to fully adhere the fatty acid metal compound to the surface of the toner particles. In the present application, the volume average particle diameter of a fatty acid metal compound is determined with a particle diameter analyzer MICROTRACK UPA from Nikkiso Co., Ltd.

The added amount of a fatty acid metal compound is preferably from 0.1 to 5.0 parts by weight, and more preferably from 0.3 to 3.0 parts by weight based on the total weight of the toner particles. When the added amount is too small, a good combination of environmental stability, transferability and cleanability cannot be imparted to the toner. In contrast, when the added amount is too large, good charging property cannot be imparted to the toner.

Specific examples of the fatty acid metal compounds for use in covering toner particles include zinc stearate, calcium stearate, magnesium stearate, aluminum stearate, zinc oleate, zinc palmitate, magnesium palmitate, zinc myristate, zinc laurate, and zinc behenate, but are not limited thereto. Among these compounds, zinc stearate is preferable because of imparting an excellent combination of environmental stability and charging property to the toner.

Specific examples of the materials for use as the external additive include particulate inorganic materials and particulate organic materials, but are not limited thereto. Among these materials, inorganic materials are preferably used. In this regard, it is preferable to add at least one kind of external additive, and more preferably one to three kinds of external additives.

Specific examples of the inorganic materials for use as the external additive include silica, alumina, titanium oxide, barium titanate, magnesium titanate, calcium titanate, strontium titanate, iron oxide, copper oxide, zinc oxide, tin oxide, silica sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc., but are not limited thereto. These inorganic materials can be subjected to a hydrophobizing treatment. Among these materials, silica, titanium oxide, and hydrophobized titanium oxide are preferable.

Specific examples of silica for use as the external additive include HDK H2000, HDK H2000/4, HDK H2050EP, HVK21 and HDK H1303, which are manufactured by Hoechst AG; and R972, R974, RX200, RY200, R202, R805 and R812, which are manufactured by Nippon Aerosil Co. Specific examples of titanium oxide for use as the external additive include P-25 manufactured by Nippon Aerosil Co.; STT-30 and STT-65C-S, which are manufactured by Titan Kogyo K.K.; TAF-140 manufactured by Fuji Titanium Industry Co., Ltd.; MT-150W, MT-500B, MT-600B and MT-150A, which are manufactured by Tayca Corp.; etc. Specific examples of hydrophobized titanium oxides for use as the external additive include T-805 manufactured by Nippon Aerosil Co.; STT-30A and STT-65S-S, which are manufactured by Titan Kogyo K.K.; TAF-500T and TAF-1500T, which are manufactured by Fuji Titanium Industry Co., Ltd.; MT-100S and MT-100T, which are manufactured by Tayca Corp.; IT-S manufactured by Ishihara Sangyo Kaisha K.K.; etc.

Suitable hydrophobizing agents for use in the hydrophobizing treatment of the inorganic materials include silane coupling agents such as methyl trimethoxy silane, methyl triethoxy silane, and octyl trimethoxy silane; and silicone oils. Specific examples of the silicone oils include dimethyl silicone oils, methylphenyl silicone oils, chrolophenyl silicone oils, methylhydrodiene silicone oils, alkyl-modified silicone oils, fluorine-modified silicone oils, polyether-modified silicone oils, alcohol-modified silicone oils, amino-modified silicone oils, epoxy-modified silicone oils, epoxy/polyether-modified silicone oils, phenol-modified silicone oils, carboxyl-modified silicone oils, mercapto-modified silicone oils, (meth)acrylic-modified silicone oils, α-methylstyrene-modified silicone oils, etc.

The volume average particle diameter of the inorganic materials used as the external additive is preferably from 0.005 to 1.0 μm, and more preferably from 0.01 to 0.5 μm. When the volume average particle diameter is too small, the inorganic materials tend to be embedded into toner particles, and thereby a good combination of fluidity and charging property cannot be imparted to the toner. When the volume average particle diameter is too large, good fluidity cannot be imparted to the toner.

Specific examples of the organic materials for use as the external additive include particulate polymers such as polymers and copolymers of styrene, methacrylate and acrylate, which are prepared by a method such as soap-free emulsion polymerization methods, suspension polymerization methods, and dispersion polymerization methods; polycondensation resins such as silicone resins, benzoguanamine resins and nylon resins; and thermosetting resins.

It is preferable that the toner of the present invention include free particles of a fatty acid metal compound in an amount of not greater than 1.0%. The ratio of free particles of the fatty acid metal compound to the total weight of the fatty acid metal compound used is determined by determining the number (Nf) of the metal atoms included in free particles of the fatty acid metal compound and the total number (Nt) of the metal atoms detected and calculating the ratio (Nf/Nt). This ratio is hereinafter referred to as free particle ratio.

In addition, when the emission voltage of carbon included in the binder resin of the toner is X, the emission voltage of an element included in the fatty acid metal compound in the toner is Y, and data of X and Y for the toner are plotted in a graph to obtain a two-third root approximated curve, the absolute deviation of the data is preferably not greater than 0.1.

The adherence ratio of external additive particles adhered to toner particles to the total of the external additive particles and the free particle ratio of free external additive particles to the total of the external additive particles can be determined by a particle analyzer method. The particle analyzer method is described in detail in the collected papers of a 95th annual conference of The Imaging Society of Japan, the collected papers of Japan Hardcopy '97, and the paper of a presentation "New method for evaluating external additive—analysis of toner using particle analyzer" by Toshiyuki SUZUKI and Toshio TAKAHARA, which was held on Jul. 9-11, 1997 and hosted by The Imaging Society of Japan. In this application, an instrument PT1000 from Yokogawa Electric Corporation is used for analyzing particles.

Hereinafter, the particle analyzer method using the instrument PT1000 will be explained. A case of a toner including toner particles, which includes carbon atoms as a main element, and a particulate silica serving as an external additive will be explained. When such a toner is set in plasma so as to be excited and to emit light, emission spectra (frequency) specific to the elements included in the toner can be obtained, wherein the emission strengths depend on the amounts of the elements in the toner. By determining the frequency and emission strength, the amount of carbon atoms in the toner particles and the amount of silica in the external additive (i.e., particulate silica) can be determined. In this regard, if a toner particle and a silica particle (external additive) are united, emissions of carbon atom and silica atom are detected at the same time, and therefore they are synchronized (hereinafter referred to as a synchronous toner particle). When a toner particle is separated from a silica particle, emissions are detected at the different times, and therefore they are not synchronized (hereinafter referred to as an asynchronous toner particle and an asynchronous silica particle).

In this analysis, the synchronous toner particle is considered to be constituted of a toner particle having a spherical form and made of carbon (C), and a silica particle having a spherical form and made of silicon. In this regard, the particle diameter of each of the spherical toner particle and the spherical silica particle is hereinafter referred to as the equivalent particle diameter. Each of the carbon equivalent particle diameter and the silicon equivalent particle diameter is determined as the cubic root voltage of the signal of the emission spectrum (which is proportional to mass of the element). This is explained in detail in JP-A 12-47425, incorporated herein by reference.

FIG. 1 is a graph for explaining synchronous distribution of a toner. Specifically, FIG. 1 illustrates the relationship between cubic root voltages (i.e., equivalent particle diameter) for carbon in toner particles and cubic root voltages (i.e., equivalent particle diameter) for silicon in external additive particles. In FIG. 1, the horizontal axis and vertical axis represent cubic root voltages for carbon and silicon, each ranging from 0 to 10 V. The data (○ marks) on the horizontal axis are for free toner particles (i.e., asynchronous toner particles), and the data (○ marks) on the vertical axis are for free external additive particles (i.e., asynchronous silica particles). In addition, the data (○ marks) having both the X-axis and Y-axis components are for synchronous toner particles. In addition, the background is measured. In order to prevent influence of noise, a select line is set. Among the selected data, the data for the synchronous toner particles are analyzed to determine the slope of the data, which is determined by a least square method. Thus, a curve, which is a two-third root approximated curve, is obtained as illustrated in FIG. 1.

Figure 2:
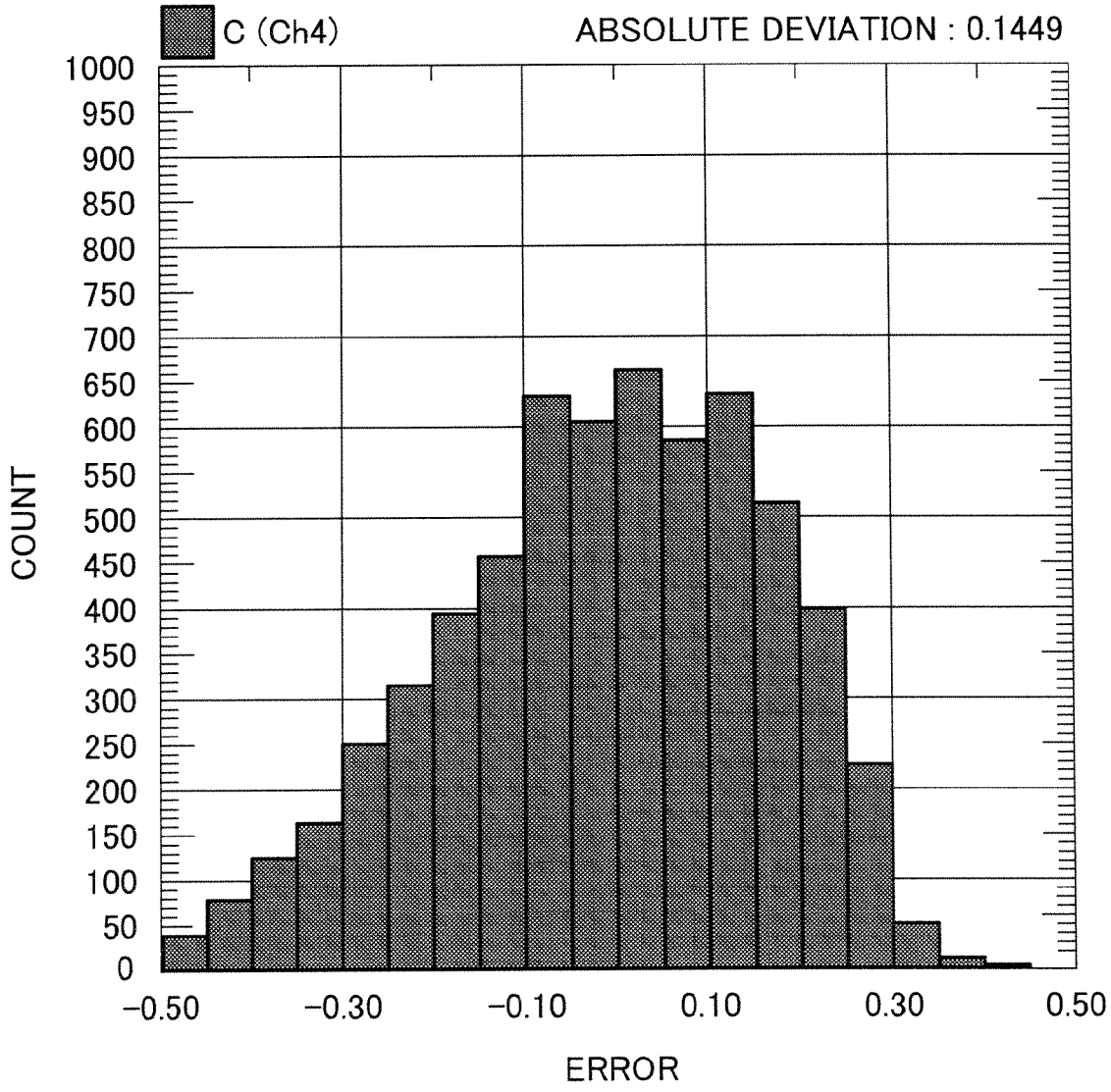
FIG. 2 is a graph for use in determining the absolute deviation from the graph of FIG. 1.

In a case of a toner including only toner particles having data on the approximated curve, the fatty acid metal compound is evenly present on the surface of the toner particles. In a case of a toner including toner particles having data scattered around the approximated curve, the fatty acid metal compound is not evenly present on the surface of the toner particles. The variation (i.e., the dispersion state of the fatty acid metal compound) can be quantitatively represented by absolute deviation, which is determined by using an analysis software. One example of determining the absolute deviation is illustrated in FIG. 2. When determining the absolute deviation, data on the X-axis and Y-axis for the free toner particles and free external additive particles (silica) are disregarded.

The absolute deviation is determined as follows.

The error (x) of each data is represented as follows.

$$x=d/H$$

wherein d represents the length of a perpendicular line (1) connecting a data point with the approximated curve, and H represents the length of a perpendicular line (2) connecting the intersection of the perpendicular line (1) and the approximated curve with the X-axis.

The absolute deviation of the data is defined by the following equation.

$$\text{Absolute deviation} = \frac{1}{n}\sum |x - x_{ave}|$$

wherein n represents the number of the error data, and $x_{ave}$ represents the average of the error data.

The absolute value can be determined by using a combination of the particle analyzer (PT1000) and the analysis software attached to the particle analyzer.

The ratio (FR) of free external additive particles in the toner is determined by the following equation:

$$FR=(F/T)\times 100(\%)$$

wherein F represents the total number of detected free external additive particles, and T represents the total number of detected external additive particles.

The instrument PT1000 from Yokogawa Electric Corporation calculates the ratio (FR) using the following equation.

$$FR=(ASC)/(ASC+SC)\times 100(\%)$$

wherein ASC represents the count for asynchronous external additive particles, and SC represents the count for synchronous external additive particles.

The instrument PT1000 displays the ratio in the window thereof. Thus, the ratio of free external additive particles in a toner can be determined as a relative value and is displayed.

The analysis result (i.e., determination of ratios of free external additive particles and free toner particles) will be explained by reference to an example of toner, which includes toner particles, which include carbon atoms as a main element, and a particulate silica serving as an external additive. An example of the analysis result (shown in the window of PT1000) is shown in Table 1 below.

TABLE 1

| Ref. | Channel | Element | Sync. Count* | ASC | ASCt*[2] | FR (%) | FRt*[3] (%) |
|---|---|---|---|---|---|---|---|
| | 1 | Si | 1376 | 80 | 1330 | 5.4945 | 49.1500 |
| | 2 | Zn | 506 | 2 | 2203 | 0.3937 | 81.3215 |
| | 3 | Ti | 326 | 3 | 2385 | 0.9119 | 87.9749 |
| ○ | 4 | C | | | | | |

Sync. count*: Synchronous count
ASCt*[2]: Count for asynchronous (free) toner particles
FRt*[3]: Ratio of free toner particles In Table 1, counts for the silica atoms in silica particles synchronous with the toner particles, counts for the silica atoms in silica particles asynchronous with the toner particles, counts for free toner particles, etc. are shown. In addition, in Table 1 the ratio of free particles on number basis is also shown for each element. In this regard, these data are based on the reference atom (i.e., carbon atom). In this regard, the element Zn is included in the fatty acid metal compound (zinc stearate), and the element Ti is included in titanium oxide used as an external additive.

It is preferable that the toner of the present invention include free particles of a fatty acid metal compound in an amount of not greater than 1.0%, and more preferably not greater than 0.5% (hereinafter referred to as condition 1). In addition, when the emission voltage of carbon included in the binder resin of the toner particles is X, the emission voltage of an element included in the fatty acid metal compound is Y, and data of X and Y for the particles of a toner are plotted in a graph to obtain a two-third root approximated curve, the absolute deviation of the data is preferably not greater than 0.1, and more preferably not greater than 0.08 (hereinafter referred to as condition 2).

The reason why a toner satisfying the conditions 1 and 2 achieves a good performance are as follows. When free particles of a fatty acid metal compound are included in a toner, such free particles cannot be detected with a particle analyzer (it is considered as a noise because the content of a metal therein is small) or are detected as free fatty acid metal compound particles. However, in the toner of the present invention, a relatively large amount of fatty acid metal compound is firmly adhered to the surface of the toner particles or a film of the fatty acid metal compound is formed on the surface of the toner particles. Therefore, the toner particles and the fatty acid metal compound are counted synchronously. In addition, when the fatty acid metal compound is adhered to the toner particles while evenly dispersed, variations in charge quantity and adhesive force of the resultant toner particles are very small, and thereby the functions of the toner can be fully performed. The fatty acid metal compound having such a state can be measured by the particle analyzer.

When the above-mentioned conditions 1 and 2 are satisfied, the toner particles and the fatty acid metal compound are moved at the same time in an image forming apparatus, and thereby the toner particles can be uniformly charged. In addition, a good combination of cleanability and environmental stability can be imparted to the toner particles because the fatty acid metal compound is evenly adhered to the toner particles. When the ratio of free fatty acid metal compound or the absolute deviation is too large, a large amount of free fatty acid metal compound is present in the toner and the amount of the fatty acid metal compound present on the toner particles largely varies. Therefore, a good combination of cleanability, environmental stability, transferability, and charging property cannot be imparted to the toner.

Next, the process of adding a fatty acid metal compound will be explained in detail.

In the fatty acid metal compound addition process, a fatty acid metal compound is added to toner particles to adhere the fatty acid metal compound to a surface of the toner particles. The mixer used for mixing the materials is not particularly limited, and known mixers for use in mixing powders can be used. Mixers capable of changing the internal temperature using a jacket etc. are preferably used. Mixing conditions such as revolutions of a rotor, rolling speed, mixing time, and mixing temperature may be changed in process of the mixing operation to change the stress on the fatty acid metal compound (i.e., to change the adhesion state of the fatty acid metal compound with the toner particles).

In addition, a mixing method in which at first a relatively high stress is applied and then a relatively low stress is applied to the fatty acid metal compound, or vice versa, can also be used.

Specific examples of the mixers include V-form mixers, locking mixers, LOEDGE MIXER, NAUTER MIXER, HENSCHEL MIXER and the like mixers.

The mixing speed at which the fatty acid metal compound is mixed with the toner particles is preferably not lower than 10 m/s, and more preferably from 10 to 150 m/s. When the mixing speed is too slow, the fatty acid metal compound cannot be well adhered to the surface of the toner particles.

Next, the process of adding an external additive will be explained. In this external additive addition process, an external additive, which is different from the fatty acid metal compound used, is mixed with the toner particles, on the surface of which the fatty acid metal compound is present. This process is performed by a method similar to the above-mentioned method used for adding a fatty acid metal compound. After the mixing operation, the resultant mixture is filtered with a 250-mesh screen to remove coarse toner particles and agglomerated toner particles.

The toner of the present invention preferably has an average circularity of from 0.925 to 0.970, and more preferably from 0.945 to 0.965. The circularity of a particle is determined by the following equation:

$$\text{Circularity}=L2/L1,$$

wherein L2 represents the length of the circumference of the projected image of a particle and L1 represents the length of the circumference of a circle having the same area as that of the projected image of the particle. The average circularity can be determined by averaging the circularities of a number of toner particles.

In addition, the content of toner particles having a circularity of less than 0.925 in the toner is preferably not greater than 15% by weight.

When the average circularity is too small, the transferability of the toner deteriorates and thereby high quality images with little toner scattering cannot be produced. In contrast, when the average circularity is too large, toner particles remaining on an image bearing member and an intermediate transfer medium cannot be well removed with a cleaning blade, and thereby images with background fouling are produced. In addition, when pictorial images are formed or a toner image remains on an image bearing member due to jamming of a receiving material sheet, residual toner particles tend to accumulate on the surface of the image bearing member, and thereby a charging roller for charging the image bearing member is contaminated with the residual toner particles, resulting in deterioration of the charging ability of the charging roller.

In the present application, the average circularity of the toner is determined by the following method using a flow-type particle image analyzer FPIA-2100 from Sysmex Corp. The procedure is as follows.

(1) a dispersion including a toner is passed through a detection area formed on a plate in the measuring instrument; and (2) the particles are optically detected by a CCD camera and then the shapes thereof are analyzed with an image analyzer.

The toner of the present invention preferably has a ratio (Dv/Dn) of the volume average particle diameter (Dv) to the number average particle diameter (Dn) of from 1.00 to 1.30, and more preferably from 1.00 to 1.20. In this case, the toner can produce high quality and high definition images. In addition, variation of the particle diameter distribution of the toner is little and the toner can maintain good developability even when the toner is agitated for a long period of time in a developing device while a fresh toner is supplied thereto. When the ratio (Dv/Dn) is too large, variation of the particle diameter distribution of the toner becomes large, and thereby the behavior of the toner varies, resulting in deterioration of fine dot reproducibility.

The toner of the present invention preferably has a volume average particle diameter (Dv) of from 3.0 to 7.0 μm.

In general, using a toner having a small average particle diameter is advantageous to produce high definition and high quality images. However, such a toner is inferior in transferability and cleanability. When a toner having a volume average particle diameter smaller than the above-mentioned range is used for a two component developer, the toner tends to cause a problem in that the developer is fixedly adhered to a carrier after long term agitation, resulting in deterioration of the charging ability of the carrier. When such a small toner is used as a one component developer, problems in that the toner forms a film on a developing roller, and the toner is fixedly adhered to members such as blades configured to form a thin toner layer tend to be caused. In addition, these phenomena are largely influenced by the content of fine toner particles. Specifically, when toner particles having a particle diameter of not greater than 2 μm are included in an amount of not less than 20% by number, the toner adhesion problem is seriously caused and in addition the charge stability of the toner seriously deteriorates. Therefore, the content of toner particles having a particle diameter of not greater than 2 μm in the toner is preferably not greater than 20% by number.

In contrast, when the volume average particle diameter of the toner is larger than the above-mentioned range, it is difficult to produce high definition and high quality images and in addition a problem in that the particle diameter distribution of the toner in a developer largely changes when the toner is used while replenishing a fresh toner to the developer, resulting in variation of image qualities tends to occur. The same is true for the case where the ratio (Dv/Dn) is too large.

As mentioned above, fine toners having a small Dv/Dn ratio tend to cause the cleaning problem in that toner particles remaining on an image bearing member cannot be easily removed with a cleaning blade. Therefore, the toner of the present invention preferably includes toner particles with a circularity of not greater than 0.950 in an amount of from 20 to 80% by number based on total particles of the toner. The reason therefore will be explained below.

At first, the relationship between the shape of toner and transferability of the toner will be explained. In full color copiers, the amount of toner particles present on an image bearing member is larger than that in black and white copiers. Therefore, it is difficult to improve the transfer efficiency by using conventional toner having irregular forms. Further, when a conventional toner having irregular forms is used, the toner tends to be fixed to the surfaces of the photoreceptor and intermediate transfer medium used (or a toner film is formed on the surfaces) due to friction therebetween, resulting in deterioration of transferability of toner images. Particularly, in full color image forming apparatus, four color toner images cannot be evenly transferred to an intermediate transfer medium, thereby producing full color images with poor evenness and color balance. Therefore, high quality full color images cannot be produced.

Toner including toner particles with a circularity of not greater than 0.950 in an amount of from 20 to 80% by number has a good combination of blade cleanability and transfer efficiency. The blade cleanability is also influenced by other factors such as choice of material for the cleaning blade and angle of the set cleaning blade against the image bearing member, and the transfer efficiency is also influenced by transfer conditions such as voltage of the transfer bias. When the toner of the present invention includes toner particles with a circularity of not greater than 0.950 in an amount of from 20 to 80% by number, good combination of blade cleanability and transfer efficiency can be maintained by optimizing the above-mentioned factors. However, when the content of toner particles with a circularity of not greater than 0.950 is too low, the blade cleanability deteriorates. In contrast, when the content of such toner particles is too high, the transfer efficiency deteriorates. The reason therefore is as follows. In this case, almost all the toner particles have irregular forms, the toner particles are not smoothly transferred (from the surface of an image bearing member to the surface of an intermediate transfer medium or a receiving material, from the surface of an intermediate transfer medium to a receiving material, etc.) and in addition the behavior of the toner particles varies. Therefore, it is difficult to evenly transfer toner images with high efficiency. In addition, the toner has unstable charging property and the toner particles of the toner tend to be easily cracked, resulting in formation of fine toner particles when the toner is agitated together with a carrier in a developing device. Thus, the toner has poor durability.

Next, the methods for measuring the above-mentioned toner properties will be explained.

Content of Toner Particles with a Circularity of not Greater than 0.950 and Average Circularity of Toner These properties are measured with an instrument FPIA-2000 from Sysmex Corp.:

(1) at first 100 to 150 ml of water from which solid foreign materials have been removed, 0.1 to 0.5 ml of a surfactant (alkylbenzenesulfonate) and 0.1 to 0.5 g of a sample (i.e., toner) are mixed to prepare a dispersion;
(2) the dispersion is further subjected to a supersonic dispersion treatment for 1 to 3 minutes using a supersonic dispersion machine to prepare a dispersion including particles of from 3,000 to 10,000 pieces/μl;
(3) the dispersion is passed through a detection area formed on a plate in the measuring instrument; and
(4) the particles are optically detected by a CCD camera and then the shapes thereof are analyzed with an image analyzer.

Particle Diameter and Particle Diameter Distribution of Toner

The particle diameter and particle diameter distribution of a toner are measured with a method using an instrument such as COULTER COUNTER TA-II and COULTER MULTISIZER II from Beckman Coulter Inc. In the present application, a system including COULTER COUNTER TA-II, an interface capable of outputting particle diameter distribution on number and volume basis (from Nikka Giken), and a personal computer PC9801 (from NEC) is used to determine the particle diameter and particle diameter distribution. Specifically, the procedure is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl or ISOTON-II manufactured by Beckman Coulter Inc.;
(2) 2 to 20 mg of a sample to be measured is added into the mixture;
(3) the mixture is subjected to an ultrasonic dispersion treatment for about 1 to 3 minutes; and
(4) the volume-basis particle diameter distribution and number-basis particle diameter distribution of the sample are measured using the instrument and an aperture of 100 μm.

In the present invention, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 μm to 40.30 μm are targeted. The volume average particle diameter (Dv) and number average particle diameter (Dn) are determined from the volume-basis particle diameter distribution and the number-basis particle diameter distribution. In addition, the ratio (Dv/Dn) can be determined by calculation.

The toner of the present invention is preferably prepared by dispersing and/or emulsifying a toner composition including at least a binder resin and a modified layered inorganic material in an aqueous medium. More preferably, at first a first binder resin, a binder resin precursor, a compound capable of subjecting the binder resin precursor to a molecular chain growth reaction and/or a crosslinking reaction, a colorant, a release agent, and a modified layered inorganic material are dissolved or dispersed in an organic solvent to prepare a toner composition liquid. The toner composition liquid is dispersed (emulsified) in an aqueous medium and subjected to a molecular chain growth reaction and/or a crosslinking reaction. Then the solvent is removed from the resultant dispersion, resulting in formation of toner particles.

Suitable materials for use as the binder resin precursor include reactive modified polyester resins (RMPE) which are modified with a group reactive with active hydrogen. For example, polyester prepolymers (A) having an isocyanate group can be preferably used as reactive modified polyester resins. Polyester prepolymers having an isocyanate group can be prepared by reacting a polycondensation product of a polyol (PO) and a polycarboxylic acid (PC) (i.e., a polyester resin having a group including an active hydrogen atom) with a polyisocyanate (PIC). Specific examples of the group including an active hydrogen atom include hydroxyl groups (alcoholic hydroxyl groups and phenolic hydroxyl groups), amino groups, carboxyl groups, mercapto groups, etc. Among these groups, the alcoholic hydroxyl groups are preferable.

Suitable materials for use as the crosslinking agent for crosslinking the reactive modified polyester resins include amines. Suitable materials for use as the molecular chain growing agent for the reactive modified polyester resins include diisocyanate compounds (such as diphenyl methane diisocyanate). Amines mentioned later in detail serve as a crosslinking agent and a molecular chain growing agent of modified polyester resins reactive with active hydrogen.

Modified polyester resins such as urea-modified polyester resins, which can be prepared by reacting a polyester prepolymer (A) having an isocyanate group with an amine (B), can be preferably used for dry toners, and particularly, toners for use in image forming apparatus including an oil-less fixing device. This is because the molecular weight of the polyester resins can be easily controlled, and good low temperature fixability and good releasability can be imparted to the resultant toner. In particular, modified polyester resins whose end portion is urea-modified have the same fluidity and transparency in the fixable temperature range as those of the original polyester resins thereof (i.e., unmodified polyester resins)

while having weak adhesiveness to heating members (such as heat rollers) of a fixing device.

Suitable polyester prepolymers for use in preparing toner particles of the toner of the present invention include polyester prepolymers which can prepared by incorporating a functional group (such as isocyanate groups) reactive with active hydrogen in a polyester having a group (such as hydroxyl groups) having active hydrogen. Modified polyester resins (MPE) (such as urea-modified polyester resins) can be prepared from the polyester prepolymers. When preparing the toner particles of the toner of the present invention, it is preferable to use urea-modified polyester resins which can be prepared by reacting such a polyester prepolymer (A) with an amine (B) serving as a crosslinking agent and/or a molecular chain growing agent. The method for preparing a polyester prepolymer (A) having an isocyanate group is mentioned above.

Suitable polyols (PO) for use in preparing polyester prepolymers (A) include diols (DIO), polyols (TO) having three or more hydroxyl groups, and mixtures of DIO and TO. Preferably, diols (DIO) alone or mixtures of a diol (DIO) with a small amount of polyol (TO) are used.

Specific examples of the diols (DIO) include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and alkylene oxide adducts of bisphenols are preferable. More preferably, alkylene oxide adducts of bisphenols, and mixtures of an alkylene oxide adduct of a bisphenol and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

Suitable polycarboxylic acids (PC) for use in preparing the modified polyester resin include dicarboxylic acids (DIC) and polycarboxylic acids (TC) having three or more carboxyl groups. Preferably, dicarboxylic acids (DIC) alone and mixtures of a dicarboxylic acid (DIC) with a small amount of polycarboxylic acid (TC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

When a polycarboxylic acid (PC) is reacted with a polyol (PO), anhydrides or lower alkyl esters (e.g., methyl esters, ethyl esters or isopropyl esters) of the polycarboxylic acids mentioned above can also be used as the polycarboxylic acid (PC).

Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

Specific examples of the polyisocyanates (PIC) for use in preparing the modified polyester resin include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., $\alpha,\alpha,\alpha',\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., the equivalence ratio [NCO]/[OH]) of the [NCO] group of a polyisocyanate (PIC) to the [OH] group of a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, thereby deteriorating the hot-offset resistance of the toner.

The content of the polyisocyanate unit in the polyester prepolymer (A) having an isocyanate group is from 0.5 to 40% by weight, preferably from 1 to 30% by weight and more preferably from 2 to 20% by weight. When the content is too low, the hot offset resistance of the toner deteriorates and in addition a good combination of preservability and low temperature fixability cannot be imparted to the resultant toner. In contrast, when the content is too high, the low temperature fixability of the toner deteriorates.

The average number of the isocyanate group included in a molecule of the polyester prepolymer (A) is generally not less than 1, preferably from 1.5 to 3, and more preferably from 1.8 to 2.5. When the average number of the isocyanate group is too small, the molecular weight of the resultant urea-modified polyester (which is crosslinked and/or extended) decreases, thereby deteriorating the hot offset resistance of the resultant toner.

The urea-modified polyester resin for use as a binder resin of the toner of the present invention can be prepared by reacting a polyester prepolymer (A) having an isocyanate group with an amine (B).

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine, etc. Specific examples of the amino alcohols (B3) include ethanol amine, hydroxyethyl aniline, etc. Specific examples of the amino mercaptan (B4) include aminoethyl mercaptan, aminopropyl mercaptan, etc. Specific examples of the amino acids (B5) include aminopropionic acid, aminocaproic acid, etc. Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc. Among these amines, diamines (B1) and mixtures of a diamine (B1) with a small amount of a polyamine (B2) are preferably used.

The molecular weight of the urea-modified polyesters can be controlled using a molecular chain growth inhibitor. Specific examples of the molecular chain growth inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., the equivalence ratio [NCO]/[NHx]) of the [NCO] group of the prepolymer (A) having an isocyanate group to the [NHx] group of the amine (B) is from 1/2 to 2/1, preferably from 1/1.5 to 1.5/1 and more preferably from 1/1.2 to 1.2/1. When the mixing ratio is too low or too high, the molecular weight of the resultant urea-modified polyester decreases, resulting in deterioration of the hot offset resistance of the resultant toner.

The toner of the present invention preferably includes a urea-modified polyester resin (UMPE) as a binder resin. In this regard, the urea-modified polyester resin can include a urethane bonding as well as a urea bonding. The molar ratio of the urea bonding to the urethane bonding is from 100/0 to 10/90, preferably from 80/20 to 20/80, and more preferably from 60/40 to 30/70. When the molar ratio of the urea bonding is too low, the hot offset resistance of the resultant toner deteriorates.

The modified polyesters such as UMPE can be prepared, for example, by a method such as one-shot methods or prepolymer methods. The weight average molecular weight of the modified polyesters is generally not less than 10,000, preferably from 20,000 to 10,000,000 and more preferably from 30,000 to 1,000,000. When the weight average molecular weight is too low, the hot offset resistance of the resultant toner deteriorates.

The number average molecular weight of the modified polyester resin is not particularly limited if an unmodified polyester resin is used in combination therewith. Specifically, the weight average molecular weight of the modified polyester resin is mainly controlled rather than the number average molecular weight. When the modified polyester resin is used alone, the number average molecular weight of the resin is preferably not greater than 20,000, preferably from 1,000 to 10,000, and more preferably from 2,000 to 8,000. When the number average molecular weight is too high, the low temperature fixability of the resultant toner deteriorates. In addition, when the toner is used as a color toner used for full color image forming apparatus, the resultant toner has low glossiness.

It is preferable for the toner of the present invention to include a combination of a modified polyester resin (such as UMPE) with an unmodified polyester resin as the binder resin of the toner. By using such a combination, the low temperature fixability of the toner can be improved and in addition the toner can produce color images having a high glossiness.

Suitable materials for use as the unmodified polyester resin (PE) include polycondensation products of a polyol (PO) with a polycarboxylic acid (PC). Specific examples of the polyol (PO) and polycarboxylic acid (PC) are mentioned above for use in the modified polyester resin. In addition, specific examples of the suitable polyol and polycarboxylic acid are also mentioned above. The weight average molecular weight (Mw) of the unmodified polyester resin (PE) is from 1,000 to 300,000, and preferably from 14,000 to 200,000. The number average molecular weight (Mn) thereof is from 1,000 to 10,000 and preferably from 1,500 to 6,000.

In addition, polyester resins including a bond (such as urethane bond) other than a urea bond are considered as the unmodified polyester resin (PE) in the present application.

When a combination of a modified polyester resin with an unmodified polyester resin is used as the binder resin, it is preferable that the modified polyester resin is at least partially mixed with the unmodified polyester resin to improve the low temperature fixability and hot offset resistance of the toner. Namely, it is preferable that the modified polyester resin has a molecular structure similar to that of the unmodified polyester resin. The mixing ratio (MPE/PE) of a modified polyester resin (MPE) to an unmodified polyester resin (PE) is from 5/95 to 60/40, preferably from 5/95 to 30/70, more preferably from 5/95 to 25/75, and even more preferably from 7/93 to 20/80. When the added amount of the modified polyester resin is too small, the hot offset resistance of the toner deteriorates and in addition, it is impossible to impart a good combination of high temperature preservability and low temperature fixability to the toner.

The unmodified polyester resin (PE) preferably has a hydroxyl value not less than 5 mgKOH/g. In addition, the unmodified polyester resin (PE) preferably has an acid value of from 1 to 30 mgKOH/g, and more preferably from 5 to 20 mgKOH/g. When an unmodified polyester resin having such an acid value, affinity of the toner for receiving papers can be improved, resulting in improvement of low temperature fixability of the toner. However, when the acid value is too large, the charge stability of the toner deteriorates particularly when environmental conditions vary. In addition, when the acid value varies in the polymerization process of preparing the unmodified polyester resin, it is difficult to control the emulsification process (i.e., the toner granulation process varies), resulting in variation in particle diameter and particle forms of the resultant toner particles.

The acid value and hydroxyl value of a resin are measured by the following methods.

Acid Value

The acid value is determined by the method described in JIS K0070-1992.

At first, about 0.5 g of a sample (resin), which is precisely measured, is mixed with 120 ml of tetrahydrofuran (THF). The mixture is agitated for about 10 hours at room temperature (23° C.) to prepare a sample solution. The sample solution is subjected to titration using a N/10 alcohol solution of potassium hydroxide. The acid value (AV) of the sample is determined by the following equation.

$$AV=(KOH\times N\times 56.1)/W$$

wherein KOH represents the amount (ml) of KOH consumed in the titration, N represents the factor of N/10 potassium hydroxide, and W represents the precise weight of the sample.

The instrument and measurement conditions are as follows.

Instrument: Automatic potentiometric titrator DL-53 (from Mettler Toledo K.K.)
Electrode: DG-113-SC (from Mettler Toledo K.K.)
Analysis software: LabX Light Version 1.00.000
Calibration: A mixture solvent of 120 ml of toluene and 30 ml of ethanol is used.
Measurement temperature: 23° C.
Conditions of the instrument
- Stir
  - Speed: 25%
  - Time: 15 sec
- EQP titration
  - Titrant/Sensor
    - Titrant: $CH_3ONa$
    - Concentration: 0.1 mol/L
    - Sensor: DG115
    - Unit of measurement: mV
  - Predispensing to volume
    - Volume: 1.0 mL
    - Wait time: 0 sec
  - Titrant addition Dynamic
    - dE (set): 8.0 mV
    - dV (min): 0.03 mL
    - dV (max): 0.5 mL
  - Measure mode Equilibrium controlled
    - dE: 0.5 mV
    - dt: 1.0 sec
    - t(min): 2.0 sec
    - t(max): 20.0 sec
  - Recognition
    - Threshold: 100.0
    - Steepest jump only: No
    - Range: No
    - Tendency: None
  - Termination
    - At maximum volume: 10.0 ml
    - At potential: No
    - At slope: No
    - After number EQPS: Yes
      - n=1
    - Comb. Termination conditions: No
  - Evaluation
    - Procedure: Standard
    - Potential 1: No
    - Potential 2: No
    - Stop for reevaluation: No Hydroxyl Value The instrument and the measurement conditions are the same as those in the above-mentioned acid value measurement method. The procedure is as follows.

At first, about 0.5 g of a sample, which is precisely measured, is mixed with 5 ml of an acetylizing agent. Then the mixture is heated in a temperature range of 100±0.5° C. using a bath. After one or two hours, the flask is drawn from the bath. After cooling the flask, water is added thereto and the mixture is shaken to decompose acetic anhydride. Further, in order to completely decompose acetic anhydride, the flask is heated for 10 minutes or more using the bath. After cooling the flask, the inner surface of the flask is well washed with an organic solvent. This liquid is subjected to a potentiometric titration treatment using a N/2 ethyl alcohol solution of potassium hydroxide to determine the hydroxyl value of the sample. The measurement method is based on JIS K0070-1966.

The modified polyester resins for use as the binder resin are typically prepared by the following method, but the preparation method is not limited thereto. At first, a polyol (PO) and a polycarboxylic acid (PC) are heated to a temperature ranging from 150 to 280° C. in the presence of an esterification catalyst such as tetrabutoxy titanate and dibutyl tin oxide to be reacted. In this case, generated water is removed under a reduced pressure, if necessary. Thus, a polyester resin having a hydroxyl group is prepared. The thus prepared polyester resin is reacted with a polyisocyanate (PIC) at a temperature ranging from 40 to 140° C. to prepare a polyester prepolymer (A) having an isocyanate group. The prepolymer (A) is reacted with an amine (B) at temperature ranging from 0 to 140° C. to prepare a urea-modified polyester resin (UMPE). The modified polyester resin preferably has a number average molecular weight of from 1,000 to 10,000 and more preferably from 1,500 to 6,000. When the materials PIC, A and B are reacted, one or more solvents may be used if desired. Specific examples of the solvents include solvents inactive with PICs such as aromatic solvents (e.g., toluene and xylene); ketones (e.g., acetone, methyl ethyl ketone and methyl isobutyl ketone); esters (e.g., ethyl acetate); amides (e.g., dimethylformamide and dimethylacetamide); and ethers (e.g., tetrahydrofuran).

In order to impart a good combination of high temperature preservability, low temperature fixability and offset resistance to the toner, the polyester resin having an acidic group preferably includes tetrahydrofuran-soluble components having a weight average molecular weight of from 1,000 to 30,000. When the average molecular weight is too low, the high temperature preservability of the toner deteriorates. In contrast, when the average molecular weight is too high, the offset resistance deteriorates due to insufficient urea-modification caused by stearic hindrance of the prepolymer.

In the present application, the molecular weight and molecular weight distribution of a resin is determined by gel permeation chromatography (GPC). The method is as follows.

1) the column is allowed to settle in a chamber heated to 40° C. so as to be stabilized;
2) tetrahydrofuran (THF) is passed through the column thus heated to 40° C. at a flow rate of 1 ml/min; and
3) then 50 to 200 μl of a tetrahydrofuran (THF) solution of a resin having a solid content of from 0.05 to 0.6% by weight is injected to the column to obtain a molecular distribution curve of the resin.

The molecular weight distribution of the resin is determined using a working curve which represents the relationship between weight and GPC counts and which is previously prepared using monodisperse polystyrenes. Specific examples of the molecular weights of the monodisperse polystyrenes include $6\times10^2$, $2.1\times10^3$, $4\times10^3$, $1.75\times10^4$, $1.1\times10^5$, $3.9\times10^5$, $8.6\times10^5$, $2\times10^6$, and $4.48\times10^6$. The monodisperse polystyrenes are available from Pressure Chemical Co., or Tosoh Corp. It is preferable to prepare a working curve using ten or more kinds of monodisperse polystyrenes. In measurements, it is preferable to use a RI (refractive index) detector as the detector.

The unmodified polyester resin used as a binder resin preferably has an acid value of from 1.0 to 50.0 mgKOH/g. In this case, by adding a basic compound (such as tertially amines) thereto, a good combination of low temperature fixability, hot offset resistance, high temperature preservability, and charge stability can be imparted to the toner. When the acid value is too high, the molecular weight growth reaction and/or crosslinking reaction of the binder resin precursor becomes insufficient, resulting in deterioration of hot offset resistance. When the acid value is too low, the dispersion stability effect is hardly produced by the basic compound added, and in addition the molecular weight growth reaction and/or crosslinking reaction tend to excessively proceed, and therefore it is difficult to control the molecular weight of the modified polyester resin.

The high temperature preservability of the modified polyester resin depends on the glass transition temperature of the unmodified polyester resin from which the modified polyester resin is derived. In the toner of the present invention, it is preferable that the polyester resin (unmodified polyester resin and polyester resin before modification) has a glass transition temperature of from 35 to 65° C. When the glass transition temperature is too low, the high temperature preservability of the toner deteriorates. In contrast, when the glass transition temperature is too high, the low temperature fixability of the toner deteriorates.

The method for measuring the glass transition temperature of a resin is measured by an instrument TG-DSC system TAS-1100 manufactured by RIGAKU CORPORATION. The procedure for measurements of glass transition temperature is as follows:

1) about 10 mg of a sample is contained in an aluminum container, and the container is set on a holder unit;
2) the holder unit is set in an electrical furnace, and the sample is heated from room temperature to 150° C. at a temperature rising speed of 10° C./min;
3) after the sample is allowed to settle at 150° C. for 10 minutes, the sample is cooled to room temperature; and
4) after the sample is allowed to settle at room temperature for 10 minutes, the sample is heated again from room temperature to 150° C. in a nitrogen atmosphere at a temperature rising speed of 10° C./min to perform a DSC measurement.

The glass transition temperature of the sample is determined using an analysis system of the TAS-100 system. Namely, the glass transition temperature is defined as the contact point between the tangent line of the endothermic curve at the temperatures near the glass transition temperature and the base line of the DSC curve.

The prepolymer (A) for use in preparing the modified polyester resin preferably has a weight average molecular weight of from 3,000 to 20,000 to impart a good combination of low temperature fixability and hot offset resistance to the toner. When the weight average molecular weight is too low, it is difficult to control the reaction speed, and thereby the targeted modified polyester resin cannot be stably prepared. In contrast, when the weight average molecular weight is too high, the targeted modified polyester resin cannot be prepared, and thereby a toner having good offset resistance cannot be prepared.

The unmodified polyester resins for use as the binder resin are typically prepared by the method mentioned above for use in preparing the polyester resin having a hydroxyl group. The thus prepared polyester resin is dissolved in a reaction liquid including a UMPE after the urea denaturation reaction.

The toner of the present invention can include a release agent. Suitable release agents include waxes having a melting point of from 50 to 120° C. When such a wax is included in the toner, the wax is dispersed in the binder resin and serves as a release agent while being present at a location between a fixing roller and the toner particles in the fixing process. Thereby the hot offset problem can be avoided without applying an oil to the fixing roller used.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. Further, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used as release agents.

The toner for use in the image forming apparatus of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner for use in the present invention.

Specific examples of the resins for use as the binder resin of the master batches include polymers of styrene or styrene derivatives, copolymers of styrene with a vinyl monomer, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

Such master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

The toner of the present invention optionally includes a charge controlling agent. Known charge controlling agents for use in conventional toners can be used for the toner of the present invention.

Specific examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The content of the charge controlling agent in the toner of the present invention is determined depending on the variables such as choice of binder resin, presence of additives, and dispersion method. In general, the content of the charge controlling agent is preferably from 0.1 to 10 parts by weight, and more preferably from 0.2 to 5 parts by weight, per 100 parts by weight of the binder resin included in the toner. When the content is too high, the charge quantity of the toner excessively increases, and thereby the electrostatic attraction between the developing roller and the toner increases, resulting in deterioration of fluidity and decrease of image density. When preparing toner particles by a pulverization method, the charge controlling agent and release agent can be mixed with a master batch and a binder resin to be melted and kneaded. When preparing toner particles by a granulation method (such as polymerization methods), the materials can be dissolved or dispersed in a solvent together with other toner constituents (such as colorants and binder resins) to prepare a toner composition liquid.

The above-mentioned charge controlling agent and release agent can be kneaded with a master batch and a binder resin. Alternatively, the charge controlling agent and the release agent can be added to an organic solvent when the toner composition liquid is prepared.

The toner of the present invention preferably has an acid value of from 0.5 to 40.0 mgKOH/g, which is caused by the carboxyl groups of the unmodified polyester resin used as a binder resin. In this case, the toner has a good combination of low temperature fixability and hot offset resistance.

The acid value of a toner can be measured by the method mentioned above for use in measuring the acid value of a binder resin. Specifically, the procedure for measuring the acid vale of a resin is repeated except that 0.5 g of a toner is used as a sample instead of 0.5 g of a resin. When the toner includes THF-insoluble components, the acid value of only the THF-soluble components is measured.

The toner of the present invention preferably has a glass transition temperature of from 40 to 70° C. In this case, the toner has a good combination of low temperature fixability, high temperature fixability and durability. When the glass transition temperature of the toner is too low, the toner causes a blocking problem in that the toner particles aggregate in a developing device and a filming problem in that a film of the toner is formed on the surface of a photoreceptor. In contrast, when the glass transition temperature of the toner is too high, the low temperature fixability of the toner deteriorates. By using a UMPE as a binder resin, relatively good high temperature preservability can be imparted to the toner compared to toners where only an unmodified polyester resin is used as the binder resin even when the UMPE has a lower glass transition temperature than the unmodified polyester resin.

The toner of the present invention is preferably prepared by the following method. However, the preparation method is not limited thereto.

A toner composition liquid, which is prepared by dissolving or dispersing toner constituents such as binder resins (including a reactive polyester), modified layered inorganic materials, colorants and additives in a solvent, is dispersed in an aqueous medium to prepare an emulsion. Suitable materials for use as the aqueous medium include water. In addition, organic solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

In the aqueous medium, a reactive modified polyester resin (such as polyester prepolymers (A) having an isocyanate group) is reacted with an amine (B) to produce a urea-modified polyester resin (UMPE). In order to stably disperse a toner composition liquid including such a polyester prepolymer (A) and a urea-modified polyester resin (UMPE) in an aqueous medium, it is preferable to apply a shearing force to the mixture. The reactive modified polyester can be mixed with other toner constituents such as colorants, colorant master batches, release agents, charge controlling agents, unmodified polyester resins when the materials are dispersed in an aqueous medium to prepare a toner composition liquid. However, it is preferable that the reactive modified polyester and the other toner constituents are previously mixed, the mixture is dissolved or dispersed in a solvent to prepare a toner composition liquid, and then the toner composition liquid is dispersed in an aqueous medium. In addition, the toner constituents such as colorants, release agents and charge controlling agents are not necessarily mixed with other toner constituents when particles are formed in an aqueous medium, and can be mixed with the resultant toner particles formed in the aqueous medium. For example, a method in which after particles including no colorant are formed in an aqueous medium, the particles are dyed with a colorant using a known dyeing method can also be used.

Known dispersing machines can be used for emulsifying the toner composition liquid in an aqueous medium. Suitable dispersing machines include low speed shearing dispersion machines, high speed shearing dispersion machines, friction dispersion machines, high pressure jet dispersion machines, ultrasonic dispersion machines, etc. In order to prepare a dispersion having a particle diameter of from 2 to 20 μm, high speed shearing dispersion machines are preferably used.

When high speed shearing dispersion machines are used, the rotation number of the rotor is not particularly limited, but the rotation number is generally from 1,000 to 30,000 rpm, and preferably from 5,000 to 20,000. The dispersion time is not particularly limited. When a batch dispersion machines are used, the dispersion time is generally from 0.1 to 5 minutes. The dispersion temperature is preferably from 0 to 150° C. and preferably from 40 to 98° C. It is preferable that dispersing is performed at a relatively high temperature because the dispersion has a low viscosity and thereby dispersing can be easily performed.

The weight ratio of the aqueous medium to the toner composition liquid including a polyester resin (such as UMPE and prepolymer (A)) is generally from 50/100 to 2,000/100 and preferably from 100/100 to 1,000/100. When the added amount of the aqueous medium is too low, the toner composition liquid cannot be well dispersed, and thereby toner particles having a desired particle diameter cannot be prepared. Adding a large amount of aqueous medium is not economical.

When the toner composition liquid is emulsified and dispersed in an aqueous medium, a dispersant such as surfactants, particulate inorganic dispersants, particulate polymer dispersants is preferably included in the aqueous medium.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkyl(C7-C13) carboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants include SARFRON S-111, S-112 and S-113, which are manufactured by Asahi Glass Co., Ltd.; FLUORAD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured byNeos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SARFRON S-121 (from Asahi Glass Co., Ltd.); FLUORAD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Inorganic dispersants hardly soluble in water, such as tricalcium phosphate, calcium carbonate, titanium oxide, colloidal silica and hydroxyapatite can also be used.

Particulate polymers have the same effect as the particulate inorganic dispersants. Specific examples of the particulate polymers include particulate methyl methacrylate having a particle diameter of 1 μm or 3 μm, particulate polystyrene having a particle diameter of 0.5 μm or 2 μm, particulate styrene-acrylonitrile copolymers having a particle diameter of 1 μm (e.g., PB-200H from Kao Corp., SPG from Soken Chemical & Engineering Co., Ltd., TECHNOPOLYMER SB from Sekisui Plastic Co., Ltd., SGP-3G from Soken Chemical & Engineering Co., Ltd., and MICROPEARL from Sekisui Fine Chemical Co., Ltd.)

Further, it is preferable to stabilize the emulsion or dispersion using a polymer protection colloid in combination with the inorganic dispersants and particulate polymers.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The thus prepared emulsion (i.e., reaction product) is agitated at a temperature lower than the glass transition temperature of the binder resin without evaporating the organic solvent to prepare aggregated particles. Then the emulsion is heated to remove the organic solvent from the emulsion while agitating the emulsion such that the emulsion has laminar flow, resulting in formation of deformed toner particles. When a dispersant, which can be dissolved in an acid or an alkali, such as calcium phosphate is used, it is preferable to dissolve the dispersant with hydrochloric acid to remove that from the toner particles, followed by washing. In addition, it is possible to remove such a dispersant by decomposing the dispersant using an enzyme. However, toner particles, on the surface of which the dispersant used remains, can also be used for the toner of the present invention.

In order to reduce the viscosity of the toner composition liquid, solvents capable of dissolving polyesters such as urea-modified polyester resins and polyester prepolymers can be used. In this case, the resultant toner particles have a sharp particle diameter distribution. Suitable solvents include volatile solvents having a boiling point less than 100° C. so as to be easily removed from the resultant toner particles. Specific examples of such volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used. The weight ratio of the solvent to the polyester prepolymer is generally from 0/100 to 300/100, preferably from 0/100 to 100/100 and more preferably from 25/100 to 70/100. When a solvent is used, the solvent is removed from the reaction product under normal or reduced pressure after the molecular weight growth reaction and/or the crosslinking reaction of a modified polyester (i.e., a polyester prepolymer) with an amine.

The reaction time is determined depending on the reactivity of the isocyanate group of the polyester prepolymer with the amine used, and is generally from 10 minutes to 40 hours, and preferably from 2 to 24 hours. The reaction temperature is generally from 0 to 150° C., and preferably from 40 to 98° C.

In addition, known catalysts such as dibutyltin laurate and dioctyltin laurate can be used, if desired, for the reaction. As mentioned above, amines (B) are typically used as the molecular weight growing agent and/or the crosslinking agent.

When preparing toner particles of the toner of the present invention, it is preferable that the reaction product, which has been subjected to a molecular weight growth reaction and/or a crosslinking reaction, is agitated at a temperature lower than the glass transition temperature of the binder resin included in the particles without evaporating the solvent included in the particles to prepare aggregated particles. After the shape and size of the resultant particles are confirmed, the solvent is removed from the reaction product at a temperature of from 10 to 50° C. By performing agitation before the solvent removal operation, the particles are deformed. The conditions such as temperature, agitation speed and agitation time should be properly determined such that the resultant toner particles have the desired shape and size. For example, when the concentration of the organic solvent in the oil phase liquid in the reaction product is high and thereby the oil phase liquid has a low viscosity, the resultant aggregated particles tend to have a spherical form. In contrast, when the concentration of the organic solvent in the oil phase liquid in the reaction product is low, particles cannot be well aggregated because the oil phase liquid has a high viscosity. Therefore, proper conditions should be set when preparing toner particles. In other words, it is possible to adjust the shape of the toner particles by adjusting the conditions.

Further, the shape of the toner particles can be adjusted by adjusting the concentration of the modified layered inorganic material in the toner composition liquid. The content of a modified layered inorganic material in the toner composition liquid is preferably from 0.05 to 10% by weight based on the solid components included in the toner composition liquid. When the concentration is too low, the oil phase liquid (i.e., the toner composition liquid) does not have a desired viscosity, and therefore the aggregated particles cannot have the targeted shape. Specifically, the oil phase liquid has a low viscosity, and therefore the aggregated particles tend to have a spherical form. In contrast, when the concentration is too high, the productivity of the toner particles deteriorates. Specifically, since the oil phase liquid has too high viscosity, the particles of the oil phase liquid in the aqueous phase liquid cannot be well aggregated. In this case, the resultant toner has poor fixing property.

The ratio (Dv/Dn) of the volume average particle diameter (Dv) of the toner to the number average particle diameter (Dn) thereof can be controlled by controlling factors such as viscosities of the aqueous phase liquid and oil phase liquid, and properties and added amount of the particulate resin included in the aqueous phase. In addition, the volume average particle diameter and the number average particle diameter of the toner can be controlled by controlling factors such as properties and added amount of the particulate resin included in the aqueous phase.

The toner of the present invention can be used for a two-component developer by being mixed with a magnetic carrier. In this case, the content of the toner is preferably from 1 to 10 parts by weight per 100 parts by weight of a carrier.

Suitable carriers for use in the two component developer include known carrier materials such as iron powders, ferrite powders, magnetite powders, magnetic resin carriers, which have a particle diameter of from about 20 to about 200 μm. The surface of the carriers may be coated with a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, fluoroterpolymers (such as terpolymers of tetrafluoroethylene, vinylidenefluoride and other monomers including no fluorine atom), silicone resins, etc.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is larger than 1 μm, it is hard to control the resistance of the resultant carrier.

The toner of the present invention can also be used as a one-component magnetic developer or a one-component non-magnetic developer, which does not include a carrier.

An embodiment of the image forming apparatus of the present invention will be explained referring to FIG. 3.

Figure 3:
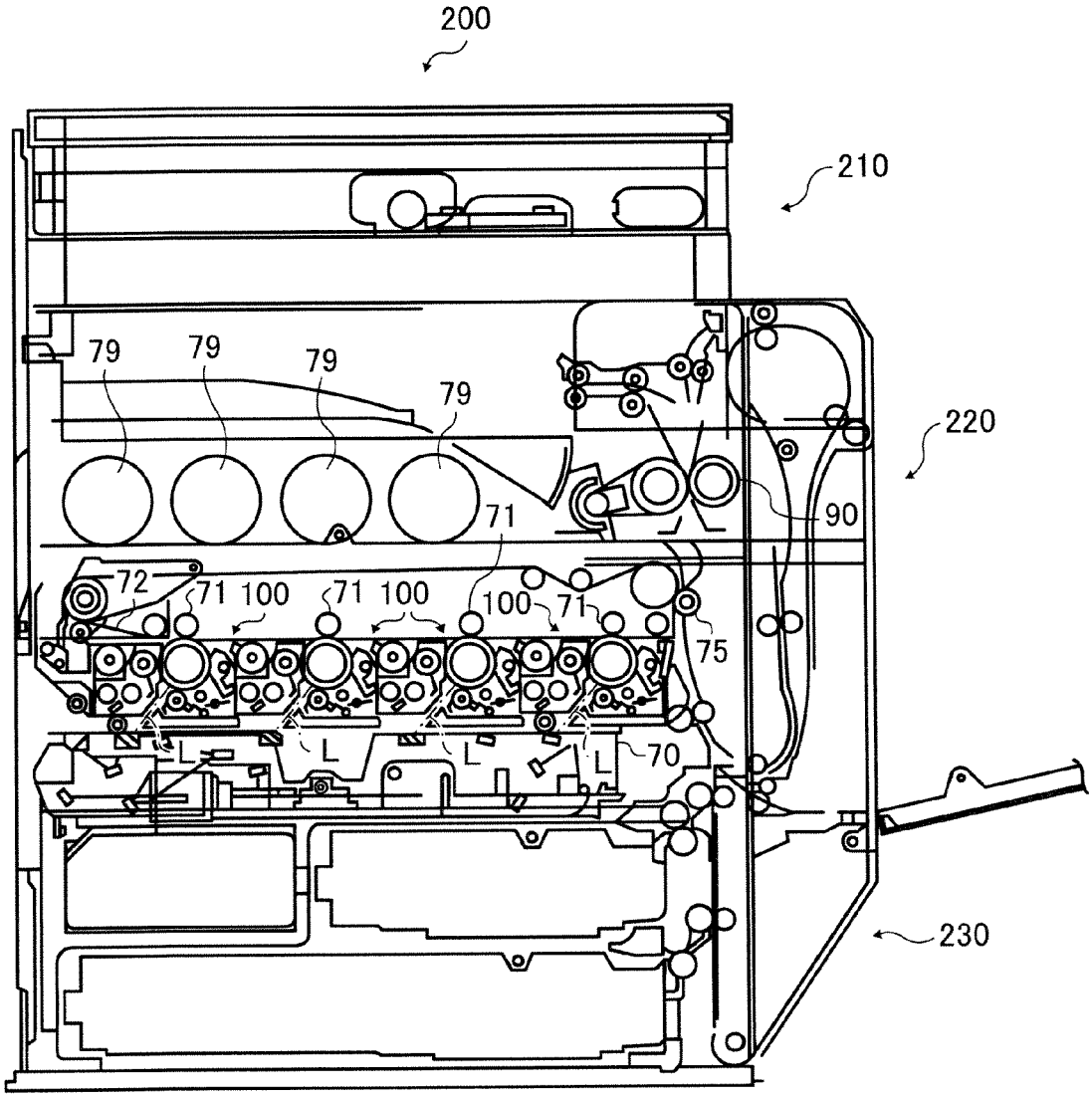
FIG. 3 is a schematic view illustrating an example of the image forming apparatus of the present invention.

FIG. 3 illustrates the cross section of a full color image forming apparatus.

Referring to FIG. 3, an image forming apparatus 200 includes a reading section 210 configured to read an original image, an image forming section 220, and a receiving material containing and feeding section 230. The image forming section 220 includes four process cartridges 100 (for forming yellow (Y), cyan (C), magenta (M) and black (K) images), which are arranged side by side in the main body of the image forming apparatus, an endless intermediate transfer belt 72 serving as an intermediate transfer medium, a secondary transfer roller 75 configured to transfer a toner image on the intermediate transfer belt to a receiving material, toner bottles 79 (serving as toner containers) configured to supply different color toners to the respective process cartridges 100, etc.

Different color toner images formed on four photoreceptors 10 (illustrated in FIG. 4) are transferred on the intermediate transfer belt 72 while overlaid. The process cartridge of the present invention includes at least an image bearing member and a developing device. The configurations and operations of the four process cartridges 100 are substantially the same except that the color of the toner is different from each other.

Figure 4:
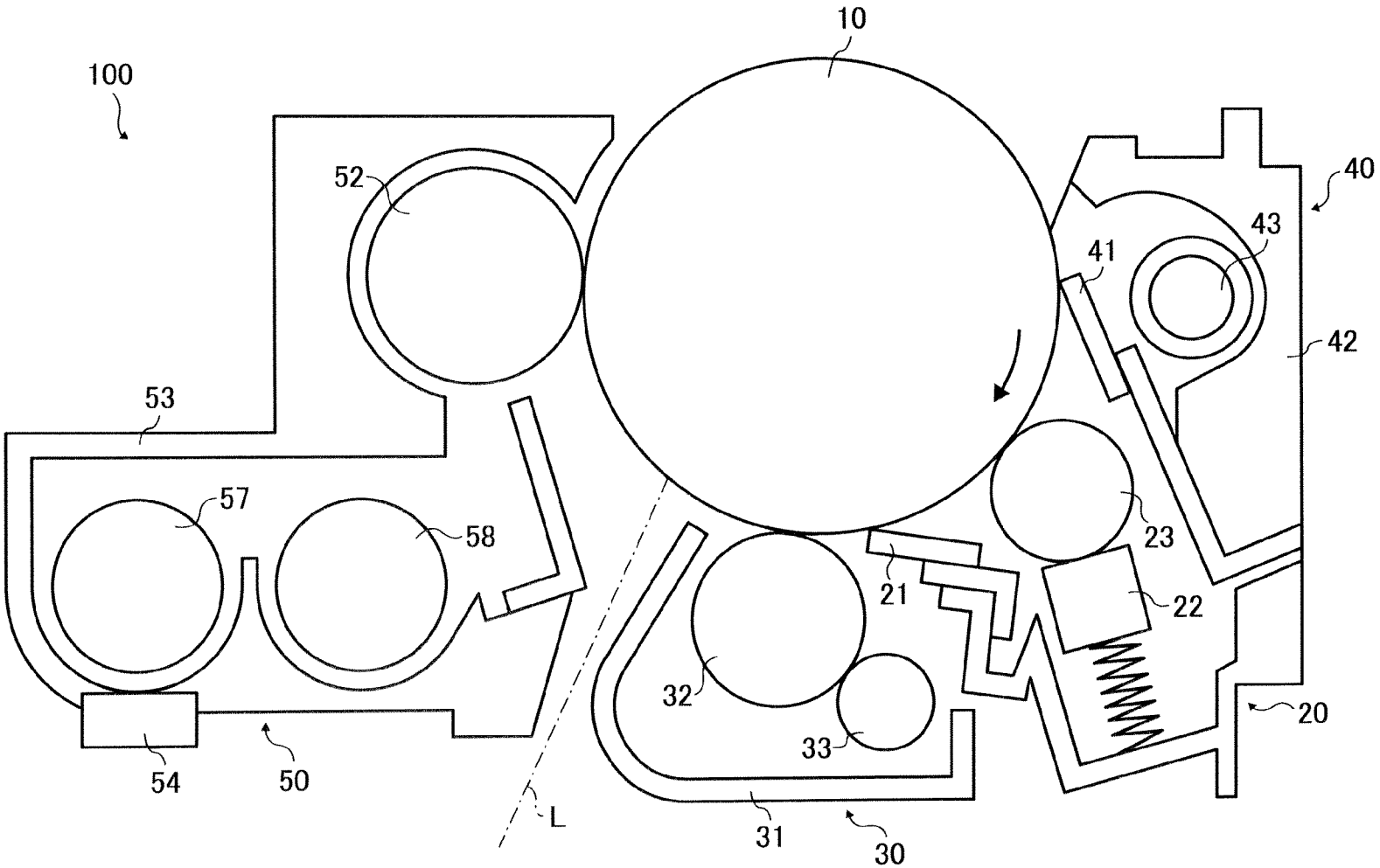
FIG. 4 is a schematic view illustrating an example of the process cartridge of the present invention.

FIG. 4 illustrates the cross section of the process cartridge 100. The process cartridge 100 includes the photoreceptor 10 serving as an image bearing member. Around the photoreceptor 10, a cleaning module 40 serving as a cleaner, a lubricant application module 20 serving as a lubricant applicator, a charging module 30 serving as a charger, and a developing module 50 serving as a developing device are arranged.

The charging module 30 includes a charging device 31 including a charging roller 32, which serves as a charging member and is arranged so as to face the surface of the photoreceptor 10, and a charging roller cleaner 33 configured to clean the surface of the charging roller 32.

The charging roller 32 uniformly charges the surface of the photoreceptor 10. Specific examples of the charging devices 31 include non-contact charging devices such as scorotron chargers and corotron chargers, which use a charge wire; contact chargers which contact a rubber roller having a medium resistance with the surface of a photoreceptor; and short range chargers which use a roller set closely to the surface of a photoreceptor. The charging device 31 illustrated in FIG. 4 is a short range charger.

Scorotron chargers have been broadly used for negatively charging photoreceptors, but have a drawback in that a large amount of ozone is generated. Therefore, recently scorotron chargers are used only for limited applications. Corotron chargers positively charge photoreceptors. Although the amount of ozone generated by corotron chargers is small, the chargers are not used popularly.

Recently, contact roller charging methods and non-contact roller charging methods are mainly used for electrophotographic image forming apparatuses because the manufacturing costs of charging rollers are reduced. The roller charging methods are classified into DC/AC charging methods in which a DC voltage overlapped with an AC voltage is applied to a photoreceptor and DC charging methods in which only a DC voltage is applied to a photoreceptor. When DC/AC charging methods are used, high quality images can be produced, but a filming problem in that a toner film is formed on a photoreceptor is easily caused.

DC/AC charging methods for contact roller charging methods have an advantage such that the potential of a photoreceptor is hardly influenced by change of resistance of the charging roller due to change of environmental conditions by performing constant AC current controlling, but have disadvantages such that the costs of the power source increases and noise due to an alternating high frequency wave is generated.

When only a DC voltage is used, the potential of a photoreceptor is seriously influenced by change of resistance of the charging roller due to change of environmental conditions. Therefore, it is necessary to provide any applied voltage compensation device when DC charging methods are used.

When DC/AC charging methods are used for non-contact roller charging methods, images with uneven image density are formed if the gap between the photoreceptor and the charger changes. Therefore, it is necessary to provide any applied voltage compensation device similarly to the case where only a DC voltage is applied. Non-contact roller charging methods have an advantage in that degree of contamination of the charging roller with foreign materials such as toner particles is lower than that in the contact charging methods. In order to apply a proper voltage to a charging roller, a device which detects the temperature near the charging roller and changes the applied voltage depending on the temperature, and a device which periodically detects the degree of contamination of the surface of the photoreceptor and changes the applied voltage depending on the degree of contamination are used. By using such devices, the potential of the photoreceptor can be controlled so as to be from about −500V to about −700V.

The method for driving the charging roller 32 is broadly classified into a driving method in which the charging roller 32 is contacted with photoreceptor 10 to be driven, or a driving method in which the charging roller is driven by a gear rotating the photoreceptor 10. The former method is typically used for low speed image forming apparatuses. The latter method is typically used for high speed image forming apparatuses or image forming apparatuses that are required to produce high quality images.

When the charging roller is contaminated, the charging ability of the contaminated portion deteriorates, and thereby the potential of a portion of the photoreceptor facing the contaminated portion is decreased, resulting in formation of abnormal images. In order to prevent formation of such abnormal images, the charging roller cleaner 33 is contacted with the charging roller 32. The charging roller cleaner 33 is typically made of a melamine resin, and is driven by the charging roller 32 without receiving any particular driving force to clean the surface of the charging roller 32.

The developing device 50 serving as the developing module includes a developing roller 52 configured to supply a developer including the toner of the present invention to the photoreceptor 10. A toner concentration sensor 54 is provided on a developer container 53 containing the developer therein. The toner sensor 54 is arranged on a bottom of a passage through which the developer including the toner and a carrier is circulated, and sends information concerning the toner concentration to the main body of the image forming apparatus. The toner concentration sensor 54 is connected with the main body by a connector to send data to the main body.

Numerals 57 and 58 denote an agitation roller configured to agitate the developer and a supply roller configured to supply the developer to the developing roller 52, respectively.

A waste toner collection coil 43 (i.e., a toner feeding auger) is arranged in the vicinity of a cleaning blade 41 of the cleaning module 40. After the waste toner collected by the cleaning blade 41 is contained in a toner containing portion 42, the waste toner is fed by the waste toner collection coil 43 to be collected.

The cleaning blade 41 is preferably made of a urethane rubber and is contacted with the surface of the photoreceptor 10 so as to counter the rotating photoreceptor. Thus, toner particles remaining on the surface of the photoreceptor 10 are scraped off by the edge of the cleaning blade 41. The toner particles are fed by the waste toner collection coil 43 to a waste toner tank (not shown). In this embodiment, the thus collected waste toner is not reused. It is preferable to stably contact the blade 41 with the surface of the photoreceptor 10 with high precision.

The lubricant application module 20 is arranged between the cleaning module 40 and the charging module 30. The lubricant application module 20 includes a solid lubricant 22, a brush roller 23 (serving as a lubricant application member) configured to apply the solid lubricant 22 on the surface of the photoreceptor 10, and a smoothing blade 21 (serving as a lubricant smoothing member) configured to smooth the coated lubricant. The lubricant is coated on the surface of the photoreceptor 10 to control the friction coefficient of the surface of the photoreceptor 10 so as to fall in a relatively low range, resulting in prevention of formation of a film (such as a toner film) on the surface of the photoreceptor 10.

The solid lubricant 22 is pressure-contacted with the brush roller 23. Therefore, the surface of the lubricant 22 is scraped by the brush roller 23, and the resultant lubricant powder is coated on the surface of the photoreceptor 10. The lubricant on the surface of the photoreceptor 10 is smoothed by the smoothing blade 21, resulting in formation of a uniform thin film of the lubricant. The smoothing blade 21 can be set on the surface of the photoreceptor 10 so as to counter or trail the photoreceptor. However, it is preferable that the smoothing blade 21 is set to trail the photoreceptor as illustrated in FIG. 4. The brush roller 23 is preferably made of a material such as insulating PET (polyethylene terephthalate) fibers, electroconductive PET fibers and acrylic fibers.

Next, the operations of the image forming apparatus 200 including the process cartridge 100 will be explained.

Referring to FIGS. 3 and 4, the photoreceptor 10 is clockwise rotated, and is charged with the charging device 31 to have the target potential with the predetermined polarity. An optical writing device 70 irradiates the charged photoreceptor 10 with a laser beam L, which has been modulated with image information, to form an electrostatic latent image on the surface of the photoreceptor 10.

The developing device 50 develops the electrostatic latent image with the developer including a toner to visualize the latent image using the toner. Thus, different color toner images are formed on the surface of the respective photoreceptors 10. The thus formed color toner images are transferred to the intermediate transfer belt 72 one by one by primary transfer rollers 71 which are arranged so as to face the respective photoreceptors with the intermediate transfer medium 72 therebetween and to which a transfer voltage is applied. Thus, color toner images are overlaid on the surface of the intermediate transfer belt 72, resulting in formation of a multi-color image.

Toner particles remaining on the surface of the photoreceptor 10 are removed therefrom by the cleaning blade 41. The solid lubricant 22 is applied on the thus cleaned surface of the photoreceptor 10 using the brush roller 23, and the coated lubricant is smoothed by the smoothing blade 21. Thus, the friction coefficient of the surface of the photoreceptor is decreased, resulting in improvement of the cleanability of the photoreceptor 10.

The multi-color image formed on the intermediate transfer medium 72 is transferred on a receiving material. Specifically, as illustrated in FIG. 3, the receiving material containing and feeding section 230 has a paper feeding cassette configured to contain sheets of the receiving material (such as papers), which is located in the bottom of the main body of the image forming apparatus. An uppermost sheet of the receiving material in the cassette is timely fed to the transfer nip between the intermediate transfer belt 72 and the secondary transfer roller 75, to which a transfer bias is applied by a power source (not shown). Therefore, the multi-color toner image on the intermediate transfer medium is secondarily transferred onto the receiving sheet.

The receiving sheet bearing the toner image is then fed to a fixing device 90, which applies heat and pressure to the image to fix the toner image on the receiving sheet. The receiving sheet on which the multi-color image is fixed is then discharged by a pair of discharge rollers to a discharge tray located on an upper portion of the image forming apparatus 200.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Resin

The following components were fed to a flask.

| | |
|---|---|
| Propylene oxide (2.2 mole) adduct of bisphenol A | 8400 g |
| Ethylene oxide (2.2 mole) adduct of bisphenol A | 24700 g |
| Terephthalic acid | 14276 g |

The mixture was agitated at 230° C. in a nitrogen atmosphere until the resultant reaction product had a softening point of 101° C. determined by the measuring method according to ASTM D36-86. Thus, a resin A was prepared.

Preparation of Charge Controlling Agent

One hundred fifty (150) grams of a modified layered montmorillonite (CLAYTON APA from Southern Clay Products), in which at least part of interlayer ions is modified with a quaternary ammonium salt having a benzyl group, was dissolved in 5000 g of water. The solution was mixed with a solution which had been prepared by dissolving 80 g of distearyldimethylammonium chloride in 5000 g of water. The mixture was filtered to obtain the precipitate. The precipitate was washed and then dried. Thus, a charge controlling agent A was prepared.

The following components were mixed using a HENSCHEL MIXER mixer.

| | |
|---|---|
| Resin A | 100 parts |
| Charge controlling agent A | 0.4 parts |
| Polypropylene wax | 3 parts |
| Cyan pigment (C.I. Pigment Blue 15:3) | 4 parts |

The mixture was kneaded by a double-axis extruder upon application of heat. Then kneaded mixture was then pulverized by a pulverizer having a collision plate, followed by classification using a dispersion separator. Thus, an untreated toner (i.e., toner particles) having a volume average particle diameter of 6.8 μm was prepared.

Next, 100 parts of the thus prepared toner particles were mixed with 1.0 part of zinc myristate (i.e., fatty acid metal compound) having a volume average particle diameter of 0.3 μm. The mixture was agitated for 5 minutes by a HENSCHEL MIXER mixer at a peripheral rotation speed of 15 m/s, followed by agitation for 10 minutes at a peripheral rotation speed of 33 m/s. In addition, 1.5 parts of an external additive A (silica HDK200H from Clariant) and 0.5 parts of an external additive C (titanium oxide SMT-150AI from Tayca Corp.) were added to the mixture. The mixture was agitated for 5 minutes by a HENSCHEL MIXER mixer at a peripheral rotation speed of 33 m/s. Further, the mixture was filtered with a screen having openings of 100 μm to remove coarse particles therefrom. Thus, a toner including a fatty acid metal compound and inorganic materials as external additives was prepared.

As a result of analysis of this toner by the particle analyzer method mentioned above, it was confirmed that the ratio of free particles of the fatty acid metal compound is 0.89% and the absolute deviation is 0.0625.

Example 2

(Preparation of Unmodified Polyester Resin)

The following components were contained in a reaction vessel equipped with a condenser, a stirrer and a nitrogen feed pipe to perform a polycondensation reaction for 8 hours at 230° C. under normal pressure.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

Then the reaction was further continued for 5 hours under a reduced pressure of from 10 to 15 mmHg (1332 to 1998 Pa).

Further, 44 parts of trimellitic anhydride was added to the vessel and the mixture was reacted for 2 hours at 180° C. under normal pressure. Thus, an unmodified polyester resin was prepared. It was confirmed that the unmodified polyester resin has a number average molecular weight of 2500, a weight average molecular weight of 6700, a glass transition temperature (Tg) of 43° C. and an acid value of 25 mgKOH/g.

(Preparation of Master Batch)

The following components were mixed using a HENSCHEL MIXER mixer from Mitsui Mining Co., Ltd.

| | |
|---|---|
| Water | 1200 parts |
| Carbon black (PRINTEX 35 from Degussa A.G. having DBP oil absorption of 42 ml/100 g and pH of 9.5) | 540 parts |
| Unmodified polyester resin prepare above | 1200 parts |

The mixture was kneaded for 30 minutes at 150° C. using a two roll mill.

Then the kneaded mixture was cooled by rolling, followed by pulverization using a pulverizer from Hosokawa Micron Corp. Thus, a master batch was prepared.

(Preparation of Wax Dispersion)

In a reaction vessel equipped with a stirrer and a thermometer, 378 parts of the unmodified polyester resin, 110 parts of a carnauba wax, 22 parts of a charge controlling agent (E-84, a metal complex of salicylic acid, from Orient Chemical Industries Co., Ltd.), and 947 parts of ethyl acetate were mixed and the mixture was heated to 80° C. while agitated. After the mixture was heated at 80° C. for 5 hours, the mixture was cooled to 30° C. over 1 hour. Then 500 parts of the master batch and 500 parts of ethyl acetate were added to the vessel, and the mixture was agitated for 1 hour to prepare a raw material dispersion.

Then 1324 parts of the raw material dispersion was subjected to a dispersing treatment using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Thus, a wax dispersion in which the carbon black and camauba wax are dispersed was prepared.

(Preparation of Toner Constituent Dispersion)

Then 1324 parts of a 65% ethyl acetate solution of the unmodified polyester resin prepared above was added to the wax dispersion. The mixture was subjected to the dispersion treatment using the bead mill. The dispersion conditions are the same as those mentioned above except that the dispersion operation was performed once (i.e., one pass).

Then 200 parts of the thus prepared dispersion was mixed with 3 parts of a modified layered montmorillonite (CLAYTON APA from Southern Clay Products), in which at least part of interlayer ions is modified with a quaternary ammonium salt having a benzyl group. The mixture was agitated for 30 minutes with a TK HOMODISPER from Tokushu Kika Kogyo Co., Ltd. Thus, a toner constituent dispersion was prepared.

(Synthesis of Intermediate Polyester)

The following components were contained in a reaction vessel equipped with a condenser, a stirrer, and a nitrogen feed pipe, and reacted for 8 hours at 230° C. under normal pressure.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyltin oxide | 2 parts |

Then the reaction was further continued for 5 hours under a reduced pressure of from 10 to 15 mmHg (1332 to 1998 Pa).

Thus, an intermediate polyester was prepared. It was confirmed that the intermediate polyester has a number average molecular weight of 2,100, a weight average molecular weight of 9,500, a glass transition temperature of 55° C., an acid value of 0.5 mgKOH/g and a hydroxyl value of 51 mgKOH/g.

(Preparation of Prepolymer)

Next, the following components were contained in a reaction vessel equipped with a condenser, a stirrer, and a nitrogen feed pipe, and reacted for 5 hours at 100° C.

| | |
|---|---|
| Intermediate polyester | 410 parts |
| Isophorone diisocyanate | 89 parts |
| Ethyl acetate | 500 parts |

Thus, a prepolymer was prepared. The prepolymer included isocyanate groups in an amount of 1.53% by weight.

(Synthesis of Amine Compound)

In a reaction vessel equipped with a stirrer and a thermometer, 170 parts of isophorone diamine and 75 parts of methyl ethyl ketone were mixed and reacted for 5 hours at 50° C. to prepare a ketimine compound. The ketimine compound has an amine value of 418 mgKOH/g.

(Preparation of Oil Phase Liquid)

In a reaction vessel, 749 parts of the toner constituent dispersion, 115 parts of the prepolymer and 2.9 parts of the ketimine compound were mixed for 1 minute using a TK HOMOMIXER which was rotated at a revolution of 5,000 rpm. Thus, an oil phase liquid (i.e., a toner composition liquid) was prepared.

(Preparation of Particulate Resin Dispersion)

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, and 1 part of ammonium persulfate were mixed. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate was added thereto, and the mixture was aged for 5 hours at 75° C. Thus, an aqueous particulate resin dispersion was prepared.

(Preparation of Dispersion Slurry)

In a reaction vessel equipped with a stirrer, 990 parts of water, 83 parts of the particulate resin dispersion prepared above, 37 parts of an aqueous solution of a sodium salt of dodecyldiphenyletherdisulfonic acid (ELEMINOL MON-7 from Sanyo Chemical Industries Ltd., solid content of 48.5%), 135 parts of a 1% by weight aqueous solution of a carboxymethyl cellulose sodium salt (CELLOGEN BS-H-3 from Dai-ichi Kogyo Seiyaku Co., Ltd., serving a polymer dispersant), and 90 parts of ethyl acetate were mixed while agitated. Thus, an aqueous medium was prepared.

Next, 867 parts of the oil phase liquid was added to 1,200 parts of the aqueous medium, and the mixture was agitated for 20 minutes using a TK HOMOMIXER mixer in which the rotor was rotated at a revolution of 13,000 rpm. Thus, a dispersion (an emulsion slurry) was prepared.

Further, the emulsion slurry was fed to a reaction vessel equipped with a stirrer and a thermometer and heated for 8 hours at 30° C. to remove the solvent therefrom. The resultant dispersion was aged for 4 hours at 45° C. Thus, a dispersion slurry was prepared.

(Preparation of Toner)

One hundred (100) parts of the dispersion slurry was filtered under a reduced pressure.

Then the wet cake was mixed with 100 parts of ion-exchange water and the mixture was agitated for 10 minutes with a TK HOMOMIXER mixer at a revolution of 12,000 rpm, followed by filtering. Thus, a wet cake (a) was prepared.

The thus prepared wet cake (a) was mixed with 100 parts of a 10% hydrochloric acid so as to have a ph of 2.8, and the mixture was agitated for 10 minutes with TK HOMOMIXER at a revolution of 12,000 rpm, followed by filtering. Thus, a wet cake (b) was prepared.

Then the wet cake (b) was mixed with 300 parts of ion-exchange water and the mixture was agitated for 10 minutes with TK HOMOMIXER at a revolution of 12,000 rpm, followed by filtering. This operation was repeated twice. Thus, a final wet cake was prepared.

The final wet cake was dried for 48 hours at 45° C. using a circulating air drier, followed by sieving with a screen having openings of 75 μm.

Thus, black toner particles were prepared.

One hundred (100) parts of the thus prepared toner particles was mixed with 1.0 part of zinc myristate (i.e., a fatty acid metal compound) having a volume average particle diameter of 0.3 μm, and the mixture was agitated for 5 minutes by a HENSCHEL MIXER mixer at a peripheral speed of 15 m/s, followed by agitation for 10 minutes at a peripheral speed of 33 m/s.

Then the toner particles were mixed with 1.5 parts of the external additive (A) and 0.5 parts of the external additive (C) using a HENSCHEL MIXER mixer. Further, the mixture was filtered with a screen having openings of 100 μm to remove coarse particles therefrom. Thus, a toner including a fatty acid metal compound and inorganic materials as external additives was prepared.

As a result of analysis of this toner by the particle analyzer method mentioned above, it was confirmed that the ratio of free particles of the fatty acid metal compound is 0.79% and the absolute deviation is 0.0785.

Example 3

The procedure for preparation of the toner in Example 1 was repeated except that the fatty acid metal compound (i.e., zinc myristate) was replaced with 1.0 part of zinc stearate having a volume average particle diameter of 0.3 μm. Thus, a toner of Example 3 was prepared. As a result of analysis of this toner by the particle analyzer method mentioned above, it was confirmed that the ratio of free particles of the fatty acid metal compound is 0.72% and the absolute deviation is 0.0695.

Example 4

The procedure for preparation of the toner in Example 1 was repeated except that the fatty acid metal compound (i.e., zinc myristate) was replaced with 1.0 part of zinc stearate having a volume average particle diameter of 0.1 μm. Thus, a toner of Example 4 was prepared. As a result of analysis of this toner by the particle analyzer method mentioned above, it was determined that the ratio of free particles of the fatty acid metal compound is 0.58% and the absolute deviation is 0.0625.

Example 5

The procedure for preparation of the toner in Example 1 was repeated except that the fatty acid metal compound (i.e., zinc myristate) was replaced with 2.0 part of zinc stearate having a volume average particle diameter of 0.1 μm. Thus, a toner of Example 5 was prepared. As a result of analysis of this toner by the particle analyzer method mentioned above, it was determined that the ratio of free particles of the fatty acid metal compound is 0.88% and the absolute deviation is 0.0599.

Example 6

The procedure for preparation of the toner in Example 2 was repeated except that the added amount of the modified layered inorganic material (i.e., CLAYTON APA) was changed from 3 parts to 0.1 parts. Thus, a toner of Example 6 was prepared. As a result of analysis of this toner by the particle analyzer method mentioned above, it was determined that the ratio of free particles of the fatty acid metal compound is 0.73% and the absolute deviation is 0.0688.

Example 7

The procedure for preparation of the toner in Example 2 was repeated except that the modified layered inorganic material (I.e., CLAYTON APA) was replaced with a modified layered montmorillonite (CLAYTON HY from Southern Clay Products), in which at least part of interlayer ions is modified with a quaternary ammonium salt having a polyoxyethylene group. Thus, a toner of Example 7 was prepared. As a result of analysis of this toner by the particle analyzer method mentioned above, it was determined that the ratio of free particles of the fatty acid metal compound is 0.68% and the absolute deviation is 0.0552.

Example 8

The procedure for preparation of the toner in Example 2 was repeated except that the added amount of the modified layered inorganic material (i.e., CLAYTON APA) was changed from 3 parts to 1.4 parts. Thus, a toner of Example 8 was prepared. As a result of analysis of this toner by the particle analyzer method mentioned above, it was determined that the ratio of free particles of the fatty acid metal compound is 0.82% and the absolute deviation is 0.0698.

Example 9

The procedure for preparation of the toner in Example 2 was repeated except that the added amount of the modified layered inorganic material (i.e., CLAYTON APA) was changed from 3 parts to 4 parts. Thus, a toner of Example 9 was prepared. As a result of analysis of this toner by the particle analyzer method mentioned above, it was determined that the ratio of free particles of the fatty acid metal compound is 0.67% and the absolute deviation is 0.0532.

Example 10

The procedure for preparation of the toner in Example 2 was repeated except that the added amount of the modified layered inorganic material (i.e., CLAYTON APA) was changed from 3 parts to 6 parts. Thus, a toner of Example 10 was prepared. As a result of analysis of this toner by the particle analyzer method mentioned above, it was determined that the ratio of free particles of the fatty acid metal compound is 0.52% and the absolute deviation is 0.0685.

Example 11

Preparation of Colorant Dispersion (1)

The following components were mixed using a bead mill (ULTRAVISCOMILL from Aimex Co., Ltd.).

| | |
|---|---|
| Carbon black (from Degussa A.G.) | 125 parts |
| Basic copolymer dispersant (AJISPER PB821 from Ajinomoto-Fine-Techno Co., Inc.) | 18.8 parts |
| Ethyl acetate (from Wako Pure Chemical Industries, Ltd.) | 356.2 parts |

Thus, a black colorant dispersion (1) was prepared.

Preparation of Release Agent Dispersion (1)

The following components were subjected to a wet pulverization treatment using a bead mill (ULTRAVISCOMILL from Aimex Co., Ltd.).

| | |
|---|---|
| Carnauba wax (melting point of 83° C., acid value of 8 mgKOH/g, saponification value of 80 mgKOH/g) | 30 parts |
| Ethyl acetate (from Wako Pure Chemical Industries, Ltd.) | 270 parts |

Thus, a release agent dispersion (1) was prepared.

Preparation of Deforming Agent Dispersion (A)

The following components were subjected to a wet pulverization treatment using a bead mill (ULTRAVISCOMILL from Aimex Co., Ltd.).

| | |
|---|---|
| Modified layered inorganic material (CLAYTON APA from Southern Clay Products) | 30 parts |
| Ethyl acetate (from Wako Pure Chemical Industries, Ltd.) | 270 parts |

Thus, a deforming agent dispersion (A) was prepared.

Preparation of Toner

The following components were mixed well.

| | |
|---|---|
| Polyester resin (reaction product of propylene oxide adduct of bisphenol A, ethylene oxide adduct of bisphenol A and terephthalic acid, having a weight average molecular weight (Mw) of 50,000, a number average molecular weight (Mn) of 3,000, and acid value of 15 mgKOH/g, a hydroxyl value of 27 mgKOH/g, a glass transition temperature (Tg) of 55° C. and a softening point of 112° C.) | 350 parts |
| Colorant dispersion (1) prepared above | 237 parts |
| Release agent dispersion (1) prepared above | 376 parts |
| Hydrophobized silica (R972 from Aerosil Co.) | 17.8 parts |

Thus, a liquid A was prepared.

On the other hand, 40 parts of calcium carbonate was dispersed in 60 parts of water. Then 100 parts of the thus prepared calcium carbonate dispersion was mixed with 200 parts of a 1% aqueous solution of CELLOGEN BS-H from Dai-ichi Kogyo Seiyaku Co., Ltd. serving as a polymer dispersant and 157 parts of water. The mixture was agitated for 3 minutes using a dispersing machine (TK HOMODISPER model f from Primix Corp.) to prepare a liquid B. Further, 345 parts of the liquid B and 250 parts of the liquid A were mixed and agitated for 2 minutes using a dispersing machine (TK HOMOMIXER mark II model f from Primix Corp.) in which the rotor was rotated at a revolution of 10,000 rpm. The emulsion was agitated with a propeller stirrer for 48 hours at room temperature and under a normal pressure. Then hydrochloric acid was added thereto to remove calcium carbonate therefrom to prepare particles. The thus prepared particles were washed, dried and classified to prepare toner particles. The average particle diameter of the toner particles was 6.2 μm.

One hundred (100) parts of the thus prepared toner particles was mixed with 1.0 part of zinc myristate (i.e., a fatty acid metal compound) having a volume average particle diameter of 0.3 μm, and the mixture was agitated for 5 minutes by a HENSCHEL MIXER mixer at a peripheral speed of 15 m/s, followed by agitation for 10 minutes at a peripheral speed of 33 m/s.

Then the toner particles were mixed with 1.5 parts of the external additive (A) and 0.5 parts of the external additive (C) using a HENSCHEL MIXER mixer. Further, the mixture was filtered with a screen having openings of 100 μm to remove coarse particles therefrom. Thus, a toner including a fatty acid metal compound and inorganic materials as external additives was prepared.

As a result of analysis of this toner by the particle analyzer method mentioned above, it was confirmed that the ratio of free particles of the fatty acid metal compound is 0.85% and the absolute deviation is 0.0865.

Example 12

Preparation of Solvent-free Resin

The following components were mixed well to prepare a monomer liquid.

| | |
|---|---|
| Styrene | 100 parts |
| Di-tert-butyl peroxide | 0.7 parts |

The monomer liquid was continuously fed to an autoclave, which is equipped with a stirrer, a heating device and a cooling device and which had been heated to 215° C. over 30 minutes. The monomer liquid was further heated for 30 minutes at 215° C. while agitated to prepare a solvent-free resin. It was confirmed that the thus prepared resin has a molecular weight peak (Mp) of 4,150 and a weight average molecular weight (Mw) of 4,800.

Preparation of Resin Emulsion

Twenty seven (27) parts of deionized water and 1 part of an anionic emulsifier (NEOGEN SC-A from Dai-ich Kogyo Seiyaku Co., Ltd.) were fed to a vessel equipped with a stirrer and a dropping pump. The mixture was agitated to prepare a solution.

Then a monomer mixture including 75 parts of styrene, 25 parts of butyl acrylate, and 0.05 parts of divinyl benzene was dropped to the solution while agitated. Thus, a monomer emulsion was prepared.

Next, 120 parts of deionized water was fed to a pressure-resistant vessel equipped with a stirrer, a pressure gauge and a thermometer. After air in the vessel was replaced with nitrogen gas, the vessel was heated to 80° C. Then 5 parts of the monomer emulsion was added to the vessel, and further 1 part of a 2% by weight aqueous solution of potassium persulfate was added thereto to perform initial polymerization. After completion of the initial polymerization, the temperature of the vessel was increased to 85° C., and residue of the monomer emulsion and 4 parts of a 2% by weight aqueous solution of potassium persulfate were added thereto over 3 hours. The mixture was further heated at 85° C. for 2 hours. Thus, a styrene resin emulsion having a solid content of 40% and including polystyrene particles having an average particle diameter of 0.15 μm was prepared. The resin emulsion could be stably prepared and had a high polymerization conversion ratio. After the resin emulsion was subjected to a centrifugal treatment to separate the resin from water, the molecular weight of the resin was measured. As a result, it was confirmed that the resin has a weight average molecular weight (Mw) of 950,000 and a molecular weight peak (Mp) of 700,000.

One hundred (100) parts of the solvent-free resin and 135 parts of the resin emulsion were mixed by a continuous kneader (KRC KNEADER from Kurimoto Ltd.) while heated to 215° C. using the jacket of the kneader to remove water therefrom. Thus, a kneaded mixture having a moisture of not greater than 0.1%. It was confirmed that the content of monomers in the kneaded mixture is 80 ppm. After being cooled, the kneaded mixture was crushed by a hammer mill, followed by pulverization using a jet mill. Thus, a styrene-acrylic resin (1) was prepared.

The procedure for preparation of the toner in Example 11 was repeated except that the polyester resin (1) was replaced with the styrene-acrylic resin (1).

As a result of analysis of this toner by the particle analyzer method mentioned above, it was confirmed that the ratio of free particles of the fatty acid metal compound is 0.65% and the absolute deviation is 0.0856.

Example 13

Five hundred (500) parts of deionized water and 5 parts of $Na_3PO_4$ were mixed. After being heated to 60° C., the mixture was agitated by a high speed agitator (CLEAMIX from M Technique Co., Ltd.) in which the rotor is rotated at a peripheral speed of 22 m/s. Then a solution which had been prepared by dissolving 2 parts of $CaCl_2$ in 15 parts of deionized water. Thus, an aqueous dispersion including $Ca_3(PO_4)_2$ was prepared.

On the other hand, the following components were mixed while heated to 60° C. and agitated to prepare a dispersion.

| | |
|---|---|
| Styrene monomer | 85 parts |
| n-butyl acrylate | 20 parts |
| Colorant (C.I. Pigment Blue 15:3) | 7.5 parts |
| Charge controlling agent (E-88 from Orient Chemical Industries Co., Ltd.) | 1 part |
| Polar resin (saturated polyester resin) (acid value of 10 mgKOH/g, peak molecular weight of 7,500) | 5 parts |
| Release agent (ester wax) (maximum endothermic peak temperature of 72° C., which is determined by DSC) | 15 parts |
| Modified layered montmorillonite (CLAYTON APA, from Southern Clay Products) | 15 parts |

A polymerization initiator, 3 parts of 2,2'-azobis(2,4-dimethylvaleronitrile) was added thereto to prepare a monomer composition liquid.

The thus prepared monomer composition liquid was added to the above-prepared aqueous dispersion. The mixture was then agitated for 15 minutes at 60° C. by a high speed agitator (CLEAMIX from M Technique Co., Ltd.), in which the rotor is rotated at a peripheral speed of 22 m/s, in a nitrogen gas atmosphere. Thus, an emulsion in which particles of the monomer composition liquid are dispersed in the aqueous dispersion was prepared. After the agitation operation, the agitator was stopped and the emulsion was fed to a polymerizing apparatus equipped with a full zone agitating blade (manufactured by Shinko Pantec). In the polymerizing apparatus, the emulsion was heated for 5 hours at 60° C. in a nitrogen gas atmosphere while rotating the agitating blade at a peripheral speed of 3 m/s to polymerize the monomers. In addition, the polymerization operation was further continued for 5 hours while raising the temperature to 80° C. After completion of polymerization, the resultant particles were washed, dried and classified. The thus prepared toner particles had an average particle diameter of 5.8 μm.

One hundred (100) parts of the thus prepared toner particles was mixed with 1.0 part of zinc myristate (i.e., a fatty acid metal compound) having a volume average particle diameter of 0.3 μm, and the mixture was agitated for 5 minutes by a HENSCHEL MIXER mixer at a peripheral speed of 15 m/s, followed by agitation for 10 minutes at a peripheral speed of 33 m/s.

Then the toner particles were mixed with 1.5 parts of the external additive (A) and 0.5 parts of the external additive (C) using a HENSCHEL MIXER mixer. Further, the mixture was filtered with a screen having openings of 100 μm to remove coarse particles therefrom. Thus, a toner including a fatty acid metal compound and inorganic materials as external additives was prepared.

As a result of analysis of this toner by the particle analyzer method mentioned above, it was confirmed that the ratio of free particles of the fatty acid metal compound is 0.498% and the absolute deviation is 0.0655.

Comparative Example 1

The procedure for preparation of the toner in Example 2 was repeated except that the fatty acid metal compound was not added.

Comparative Example 2

The procedure for preparation of the toner in Example 2 was repeated except that the fatty acid metal compound and the modified layered montmorillonite (CLAYTON APA) were not added.

Comparative Example 3

The procedure for preparation of the toner in Example 2 was repeated except that added amount of the modified layered montmorillonite (CLAYTON APA) was changed from 3 parts to 10 parts. However, the toner composition dispersion had a very high viscosity, and thereby emulsification could not be performed. Therefore, toner particles could not be prepared.

Comparative Example 4

The procedure for preparation of the toner in Example 2 was repeated except that the modified layered montmorillonite (CLAYTON APA) was replaced with 45 parts of an organo silica sol (a dispersion of a silica in an organic solvent, MEK-ST-UP from Nissan Chemical Industries, Ltd.) and the fatty acid metal compound was not added.

Comparative Example 5

The procedure for preparation of the toner in Example 2 was repeated except that the modified layered montmorillonite (CLAYTON APA) was replaced with unmodified layered inorganic material (montmorillonite) (KUNIPIA from Kunimine Industries Co., Ltd.)

The thus prepared toners were evaluated as follows.

1. Volume Average Particle Diameter (Dv), Number Average Particle Diameter (Dn), Ratio (Dv/Dn)

The average particle diameters Dv and Dn are determined by the method mentioned above.

The ratio (Dv/Dn) is calculated from the thus determined average particle diameters Dv and Dn.

2. Average Circularity

The average circularity of the toner can be determined by a flow-type particle image analyzer, FPIA-2100 manufactured by Sysmex Corp., and an analysis software FPIA 2100 DATA PROCESSING PROGRAM FOR FPIA VERSION 00-10.

Specifically, the method is as follows:

(1) 0.5 ml of a 10% surfactant (alkylbenzenesulfonate, NEOGEN SC-A from Dai-ichi Kogyo Seiyaku Co., Ltd.) is fed into a 100-ml glass beaker;
(2) 0.1 to 0.5 g of a sample (i.e., a toner) is fed to the beaker, and the mixture is agitated by a micro spatula;
(3) 80 ml of ion-exchange water is fed to the beaker;
(4) the mixture is dispersed for 3 minutes by a supersonic dispersing machine (W-113MK-II from Honda Electronics Co., Ltd.) to prepare a toner dispersion; and
(5) the average circularity of the sample in the suspension is determined by the measuring instrument mentioned above, wherein the concentration of the dispersion is controlled such that the dispersion includes particles of 5,000 to 15,000 per 1 micro-liter.

The concentration can be controlled by adjusting the added amounts of the toner and the surfactant. The added amount of the surfactant changes depending on the degree of hydrophobicity of the toner. However, when the added amount of the surfactant is too large, foams are generated and thereby noise is produced in measurement. In contrast, when the added amount is too small, toner particles cannot be well dispersed. The added amount of the toner should be changed depending on the particle diameter of the toner. Specifically, when the toner has a relatively small particle diameter, the added amount should be decreased. When the toner has a relatively large particle diameter, the added amount should be increased. When the toner has a particle diameter of from 3 to 7 μm, the added amount is from 0.1 to 0.5 g. In this case, the dispersion can include particles of 5,000 to 15,000 per 1 micro-liter.

3. Shape Factor SF-1

The shape factor SF-1 represents the degree of the roundness of a toner and is defined by the following equation (1):

$$SF\text{-}1\{(MXLNG)^2/(\text{AREA})\}\times(100\pi/4) \quad (1)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. The more the difference between the SF-1 and 100, the more irregular forms the toner particles have.

The shape factor SF-1 is determined by the following method:

(1) particles of a toner are subjected to a vacuum evaporation treatment;

(2) the particles are photographed using a super high definition scanning electron microscope (S-5200, manufactured by Hitachi Ltd.) under a condition of 2.5 KeV in acceleration voltage; and (3) photograph images of 100 toner particles are analyzed using an image analyzer (LUZEX 3 manufactured by Nireco Corp.) to determine the shape factor SF-1.

4. Cleanability (CL)

Each developer (i.e., a mixture of 7 parts by weight of a toner and 93 parts of a carrier) was set in an image forming apparatus and 10,000 copies of an original image with an image area proportion of 5% were produced. After production of the first, $1{,}000^{th}$ and $10{,}000^{th}$ images, the toner particles which remained on the photoreceptor even after a cleaning operation were transferred to an adhesive tape, SCOTCH TAPE from Sumitomo 3M Ltd. The blank adhesive tape and the adhesive tape bearing the residual toner particles were adhered on a white paper to determine the difference in optical density between the blank adhesive tape and the adhesive tape bearing the residual toner particles thereon. The optical density was measured by a reflection densitometer RD-514 manufactured by Macbeth Co. Cleanability is graded as follows.

○: Difference in density is not greater than 0.01.

X: Difference in density is greater than 0.01.

5. Fixability (Low Temperature Fixability and Hot Offset Resistance)

Each developer (i.e., a mixture of 7 parts by weight of a toner and 93 parts of a carrier) was set in a color copier MF2200 from Ricoh Co., Ltd. which is modified so as to have a fixing device having a fixing roller whose surface is made of a fluorine resin TEFLON, and solid toner images were formed on sheets of a paper TYPE 6200 from Ricoh Co., Ltd. while changing the temperature of the fixing roller, to determine the maximum fixable temperature (Tmax) and the minimum fixable temperature (Tmin) of each toner.

When maximum fixable temperature is determined, the fixing conditions are as follows.

Fixing speed: 50 mm/sec

Fixing pressure: $1.96\times10^5$ Pa (2.0 Kgf/cm$^2$) in surface pressure

Fixing nip width: 4.5 mm.

The maximum fixable temperature (Tmax) was determined as follows.

1) the fixed images were carefully observed to determine whether a hot offset problem occurs.

The maximum fixable temperature (Tmax) is defined as a fixing temperature above which a hot offset phenomenon is observed in the fixed images.

When minimum fixable temperature is determined, the fixing conditions are as follows.

Fixing speed: 120 to 150 mm/sec

Fixing pressure: $1.18\times10^5$ Pa (1.2 Kgf/cm$^2$) in surface pressure

Fixing nip width: 3 mm.

The minimum fixable temperature (Tmin) was determined as follows.

1) the toner images fixed at different fixing temperatures were rubbed with a pad; and 2) the image densities of the images were measured before and after the rubbing to determine the fixing rate (FR):

$$FR=\{(ID2)/(ID1)\}\times100(\%)$$

wherein ID1 represents the image density before rubbing and ID2 represents the image density after rubbing.

The minimum fixable temperature is defined as a fixing temperature below which the fixed image has a fixing rate less than 70%.

The hot offset resistance is graded as follows.

◎: The maximum fixable temperature is not lower than 201° C.

○: The maximum fixable temperature is from 191° C. to 200° C.

□: The minimum fixable temperature is from 181° C. to 190° C.

Δ: The minimum fixable temperature is from 171° C. to 180° C.

X: The minimum fixable temperature is not higher than 170° C.

The low temperature fixability is graded as follows.

◎: The minimum fixable temperature is lower than 120° C.

○: The minimum fixable temperature is not lower than 120° C. and lower than 130° C.

□: The minimum fixable temperature is not lower than 130° C. and lower than 140° C.

Δ: The minimum fixable temperature is not lower than 140° C. and lower than 150° C.

X: The minimum fixable temperature is not lower than 150° C.

Conventional toners typically have a minimum fixable temperature of from 140 to 150° C.

6. Image Density

Each developer (i.e., a mixture of 7 parts by weight of a toner and 93 parts of a carrier) was set in a digital full color copier IMAGIO COLOR 2800 from Ricoh Co., Ltd., and 150,000 monochrome copies of an original image with image area proportion of 50% were produced on sheets of a receiving paper TYPE 6000 from Ricoh Co., Ltd. After the running test, the image density of the last image is measured with a densitometer X-Rite (from X-Rite). This image forming operation was performed under two environmental conditions 30° C./80% RH and 10° C./15% RH.

The image density is graded as follows.

◎: The image density is not lower than 1.8 and lower than 2.2.

○: The image density is not lower than 1.4 and lower than 1.8.

Δ: The image density is not lower than 1.2 and lower than 1.4.

X: The image density is lower than 1.2.

The evaluation results are shown in Tables 2-1 and 2-2.

TABLE 2-1

| | DV (μm) | Dn (μm) | Dv/Dn | Average circularity | SF-1 | Free Particle Ratio (%) | Absolute deviation |
|---|---|---|---|---|---|---|---|
| Ex. 1 | 6.8 | 5.91 | 1.15 | 0.935 | 160 | 0.89 | 0.0625 |
| Ex. 2 | 5.1 | 4.9 | 1.05 | 0.947 | 151 | 0.79 | 0.0785 |
| Ex. 3 | 5.1 | 4.9 | 1.05 | 0.947 | 151 | 0.72 | 0.0695 |
| Ex. 4 | 5.1 | 4.9 | 1.05 | 0.947 | 151 | 0.58 | 0.0625 |
| Ex. 5 | 5.1 | 4.9 | 1.05 | 0.947 | 151 | 0.88 | 0.0599 |
| Ex. 6 | 4.6 | 4.3 | 1.08 | 0.958 | 128 | 0.73 | 0.0688 |
| Ex. 7 | 5.5 | 5.0 | 1.09 | 0.953 | 133 | 0.68 | 0.0552 |
| Ex. 8 | 5.8 | 5.2 | 1.11 | 0.950 | 138 | 0.82 | 0.0698 |
| Ex. 9 | 5.2 | 4.8 | 1.08 | 0.938 | 158 | 0.67 | 0.0532 |
| Ex. 10 | 5.9 | 5.2 | 1.13 | 0.921 | 195 | 0.52 | 0.0685 |
| Ex. 11 | 6.2 | 5.0 | 1.25 | 0.958 | 128 | 0.85 | 0.0865 |
| Ex. 12 | 5.7 | 4.7 | 1.22 | 0.964 | 131 | 0.65 | 0.0856 |
| Ex. 13 | 5.8 | 4.4 | 1.31 | 0.961 | 130 | 0.498 | 0.0655 |
| Comp. Ex. 1 | 6.8 | 5.91 | 1.15 | 0.935 | 160 | — | — |
| Comp. Ex. 2 | 5.1 | 4.9 | 1.05 | 0.947 | 151 | — | — |

TABLE 2-1-continued

| | DV (μm) | Dn (μm) | Dv/Dn | Average circularity | SF-1 | Free Particle Ratio (%) | Absolute deviation |
|---|---|---|---|---|---|---|---|
| Comp. Ex. 3 | — (Could not be measured) | — | — | — | — | — | — |
| Comp. Ex. 4 | 4.8 | 4.3 | 1.12 | 0.958 | 128 | — | — |
| Comp. Ex. 5 | 5.8 | 4.4 | 1.31 | 0.981 | 128 | 0.79 | 0.0785 |

TABLE 2-2

| | Cleanability | | | Low | | Image density | |
|---|---|---|---|---|---|---|---|
| | First image | 1000th image | 10000th image | temp. fixability | Hot offset Resist. | 30° C. 80% RH | 10° C. 15% RH |
| Ex. 1 | ○ | ○ | ○ | ○ | ○ | ○ | ○ |
| Ex. 2 | ○ | ○ | ○ | ◎ | ◎ | ◎ | ○ |
| Ex. 3 | ○ | ○ | ○ | ◎ | ◎ | ◎ | ○ |
| Ex. 4 | ○ | ○ | ○ | ◎ | ◎ | ◎ | ○ |
| Ex. 5 | ○ | ○ | ○ | ◎ | ◎ | ○ | ○ |
| Ex. 6 | ○ | ○ | ○ | ○ | ◎ | ○ | ○ |
| Ex. 7 | ○ | ○ | ○ | ○ | ◎ | ○ | ○ |
| Ex. 8 | ○ | ○ | ○ | ◎ | ◎ | ○ | ○ |
| Ex. 9 | ○ | ○ | ○ | ◎ | ◎ | ○ | ○ |
| Ex. 10 | ○ | ○ | ○ | ◎ | ○ | ○ | ○ |
| Ex. 11 | ○ | ○ | ○ | ○ | ◎ | ○ | ○ |
| Ex. 12 | ○ | ○ | ○ | □ | ◎ | ○ | ○ |
| Ex. 13 | ○ | ○ | ○ | ○ | ◎ | ○ | ○ |
| Comp. Ex. 1 | ○ | ○ | ○ | ○ | ○ | ○ | X |
| Comp. Ex. 2 | X | Could not be evaluated | Could not be evaluated | ◎ | ◎ | ○ | ○ |
| Comp. Ex. 3 | Could not be evaluated | Could not be evaluated | Could not be evaluated | Could not be evaluated | Could not be evaluated | Could not be evaluated | Could not be evaluated |
| Comp. Ex. 4 | ○ | ○ | ○ | Δ | □ | ○ | ○ |
| Comp. Ex. 5 | X | Could not be evaluated | Could not be evaluated | X | ◎ | ○ | ○ |

It is clear from Tables 2-1 and 2-2 that the toners of the present invention have good cleanability even after long repeated use while having good fixing properties, and can produce high density images even when environmental conditions change. In contrast, the comparative toners have one or more drawbacks. The toner of Comparative Example 2 causes a cleaning problem from the first image, and therefore the long term evaluation could not be performed.

This document claims priority and contains subject matter related to Japanese Patent Application No. 2006-250780, filed on Sep. 15, 2006, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

toner particles including:

a binder resin, and a modified layered inorganic material in which at least part of interlayer ions is replaced with an organic ion where the modified layered inorganic material is located on a surface portion of the toner particles;

a fatty acid metal compound located on a surface of the toner particles; and an external additive located on the fatty acid metal compound, wherein the external additive is a material different from the fatty acid metal compound, wherein the toner has an average circularity of from 0.925 to 0.970.

2. The toner according to claim 1, wherein a weight ratio of free particles of the fatty acid metal compound to total of the fatty acid metal compound is not greater than 1.0%, which is determined using a particle analyzer, and wherein when an emission voltage of carbon included in the binder resin of the toner particles is X, an emission voltage of an element included in the fatty acid metal compound is Y, and data of X and Y for the toner are plotted in a graph to obtain a two-third root approximated curve, the absolute deviation is not greater than 0.1.

3. The toner according to claim 1, wherein the toner is prepared by mixing the toner particles with the fatty acid metal compound, followed by mixing with the external additive, wherein the fatty acid metal compound has a volume average particle diameter of from 0.1 to 3.0 μm before being mixed with the toner particles.

4. The toner according to claim 1, wherein the modified layered inorganic material is a layered inorganic material in which at least part of interlayer cations is replaced with an organic cation.

5. The toner according to claim 1, wherein the toner is prepared by a method comprising:

dispersing or emulsifying a toner composition including at least the modified layered inorganic material in an aqueous medium.

6. The toner according to claim 1, wherein the toner is prepared by a method comprising:

dissolving or dispersing a toner composition including at least a first binder resin, a resin precursor of a second binder resin, a compound capable of making a reaction selected from the group consisting of molecular weight growth reactions, crosslinking reactions and combinations thereof with the resin precursor, a colorant, a release agent, and the modified layered inorganic material in an organic solvent to prepare a toner composition liquid;

subjecting the toner composition liquid to the reaction in an aqueous medium to prepare an emulsion; and removing the organic solvent from the emulsion to prepare the toner particles.

7. The toner according to claim 6, wherein the first binder resin has a polyester skeleton.

8. The toner according to claim 7, wherein the first binder resin is an unmodified polyester resin.

9. The toner according to claim 6, wherein the first binder resin has an acid value of from 1.0 to 50.0 mgKOH/g.

10. The toner according to claim 6, wherein the first binder resin has a glass transition temperature of from 35 to 65° C.

11. The toner according to claim 6, wherein the resin precursor is a modified polyester resin.

12. The toner according to claim 6, wherein the binder resin precursor includes a group reactive with active hydrogen and has a weight average molecular weight of from 3,000 to 20,000.

13. The toner according to claim 6, wherein the modified layered inorganic material is included in the toner composition liquid in an amount of from 0.05 to 10% by weight based on total weight of solid components included in the toner composition liquid.

14. The toner according to claim 6, wherein the binder resin includes polyester resin components in an amount of from 50 to 100% by weight based on total weight of the binder resin.

15. The toner according to claim 14, wherein the polyester resin components include tetrahydrofuran-insoluble components having a weight average molecular weight of from 1,000 to 30,000.

16. The toner according to claim 1, wherein a ratio Dv/Dn of a volume average particle diameter (Dv) of the toner to a number average particle diameter (Dn) thereof is from 1.00 to 1.30 and the toner includes particles having a circularity of not greater than 0.950 in an amount of from 20 to 80% by number based on total particles of the toner.

17. The toner according to claim 1, wherein the toner includes particles having a particle diameter of not greater than 2 μm in an amount of not greater than 20% by number.

18. The toner according to claim 1, wherein the toner has an acid value of from 0.5 to 40 mgKOH/g.

19. The toner according to claim 1, wherein the toner has a glass transition temperature of from 40 to 70° C.

20. An image forming apparatus comprising:

an image bearing member configured to bear an electrostatic latent image thereon;

a developing device configured to develop the electrostatic latent image with a developer including the toner according to claim 1 to form a toner image on the image bearing member;

a transfer device configured to transfer the toner image onto a receiving material optionally via an intermediate transfer medium; and a fixing device configured to fix the toner image on the receiving material.

21. A method for preparing the toner according to claim 1, comprising:

dispersing or emulsifying a toner composition including at least a modified layered inorganic material in which at least part of interlayer ions is replaced with an organic ion in an aqueous medium to prepare a liquid including toner particles;

mixing a fatty acid metal compound with the toner particles so that the fatty acid metal compound is located on a surface of the toner particles; and second mixing the toner particles with an external additive different from the fatty acid metal compound so that the external additive is located on the fatty acid metal compound.

22. A method for preparing the toner according to claim 1, comprising:

dissolving or dispersing a toner composition including at least a first binder resin, a resin precursor of a second binder resin, a compound capable of making a reaction selected from the group consisting of molecular weight growth reactions, crosslinking reactions and combinations thereof with the resin precursor, a colorant, a release agent, and the modified layered inorganic material in an organic solvent to prepare a toner composition liquid;

subjecting the toner composition liquid to the reaction in an aqueous medium to prepare an emulsion;

removing the organic solvent from the emulsion to prepare toner particles;

mixing a fatty acid metal compound with the toner particles so that the fatty acid metal compound is located on a surface of the toner particles; and second mixing the toner particles with an external additive different from the fatty acid metal compound so that the external additive is located on the fatty acid metal compound.

* * * * *